US008162440B2

(12) United States Patent
Park et al.

(10) Patent No.: US 8,162,440 B2
(45) Date of Patent: Apr. 24, 2012

(54) INKJET PRINTHEAD AND METHOD OF MANUFACTURING THE SAME

(75) Inventors: Sung-Joon Park, Suwon-si (KR); Myong-Jong Kwon, Suwon-si (KR); Jin-Wook Lee, Seoul (KR); Young-Ung Ha, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 411 days.

(21) Appl. No.: 12/575,087

(22) Filed: Oct. 7, 2009

(65) Prior Publication Data

US 2010/0165044 A1 Jul. 1, 2010

(30) Foreign Application Priority Data

Dec. 31, 2008 (KR) ..... 10-2008-0138722

(51) Int. Cl.
*B41J 2/14* (2006.01)

(52) U.S. Cl. ..... 347/47; 29/890.1

(58) Field of Classification Search ..... 347/40, 347/43, 47, 62–63; 29/890.1
See application file for complete search history.

(56) References Cited

U.S. PATENT DOCUMENTS 6,336,713 B1 * 1/2002 Regan et al. ..... 347/62
6,409,316 B1 * 6/2002 Clark et al. ..... 347/63
6,540,334 B1 * 4/2003 Mrvos et al. ..... 347/64
7,204,574 B2 4/2007 Bertelsen et al.

FOREIGN PATENT DOCUMENTS

JP 2005-219459 8/2005

OTHER PUBLICATIONS

English language abstract of JP 2005-219459, published Aug. 18, 2005.
Machine English language translation of JP 2005-219459, published Aug. 18, 2005.

* cited by examiner

*Primary Examiner* — Lamson Nguyen
(74) *Attorney, Agent, or Firm* — Staas & Halsey LLP

(57) ABSTRACT

Provided are an inkjet printhead and a method of manufacturing the same. The inkjet printhead includes: a substrate including an ink feed hole; a chamber layer formed on the substrate and including a plurality of ink chambers in which ink supplied from the ink feed hole may be filled; and a nozzle layer formed on the chamber layer and including a plurality of nozzles through which ink may be ejected, wherein the chamber layer and the nozzle layer are respectively formed of cured products of a first negative photoresist composition and a second negative photoresist composition, wherein the first negative photoresist composition and the second negative photoresist composition include a bisphenol-A novolac epoxy resin represented by Formula 1; at least one epoxy resin selected from a first epoxy resin represented by Formula 2, and a second epoxy resin represented by Formula 3; a cationic photoinitiator; and a solvent.

18 Claims, 18 Drawing Sheets

INKJET PRINTHEAD AND METHOD OF MANUFACTURING THE SAME

CROSS-REFERENCE TO RELATED PATENT APPLICATION

This application claims the benefit of Korean Patent Application No. 10-2008-0138722, filed on Dec. 31, 2008 in the Korean Intellectual Property Office, the disclosure of which is hereby incorporated by reference in its entirety for all purposes.

TECHNICAL FIELD

The present disclosure relates generally to thermal operation type inkjet printheads and methods for manufacturing the same.

BACKGROUND OF RELATED ART

Inkjet printheads are devices for printing an image on a printing medium by ejecting droplets of ink onto a desired region of the printing medium. Depending on the mechanism of ejecting ink droplets, inkjet printheads may be classified into two different types: a thermal inkjet printhead; and a piezoelectric inkjet printhead. A thermal inkjet printhead requires ink to be heated to form ink bubbles and the expansive force of the bubbles causes ink droplets to be ejected, whereas a piezoelectric inkjet printhead requires a piezoelectric crystal to be deformed and the pressure due to the deformation of the piezoelectric crystal causes ink droplets to be ejected.

For a thermal inkjet printhead, the mechanism of ejecting ink droplets first involves heating the ink. When current in the form of a pulse wave is supplied to a heater, which may be in the form of a heating resistor, the ink surrounding the heater is quickly heated to about 300° C. Accordingly, the ink boils to generate bubbles, which expand to apply pressure to the ink filled in the ink chamber. Ultimately, the ink in the vicinity of a nozzle may be ejected through the nozzle in the form of droplets.

The thermal inkjet printhead may have a structure in which a chamber layer and a nozzle layer are sequentially stacked on a substrate on which a plurality of material layers are formed. A plurality of the ink chambers, which are filled with ink to be ejected, are formed in the chamber layer, and a plurality of nozzles through which ink may be ejected are formed in the nozzle layer. In addition, the structure includes an ink feed hole passing there through, which supplies ink to the ink chambers.

SUMMARY OF THE DISCLOSURE

The present disclosure provides an inkjet printhead using cured products of a photoresist composition having excellent mechanical properties, a strong adhesion force with a substrate, and flexibility. The disclosure also provides methods for manufacturing the disclosed inkjet printhead.

According to an aspect of the present disclosure, there is provided an inkjet printhead including: a substrate having an ink feed hole; a chamber layer formed on the substrate, wherein the chamber layer includes a plurality of ink chambers in which ink supplied from the ink feed hole may be filled; and a nozzle layer, wherein the nozzle layer may be formed on the chamber layer and includes a plurality of nozzles through which ink may be ejected, wherein the chamber layer and the nozzle layer are respectively formed of cured products of a first negative photoresist composition and a second negative photoresist composition, wherein the first negative photoresist composition and the second negative photoresist composition include a bisphenol-A novolac epoxy resin represented by Formula 1; at least one epoxy resin selected from a first epoxy resin represented by Formula 2; and a second epoxy resin represented by Formula 3; a cationic photoinitiator; and a solvent.

Formula 1

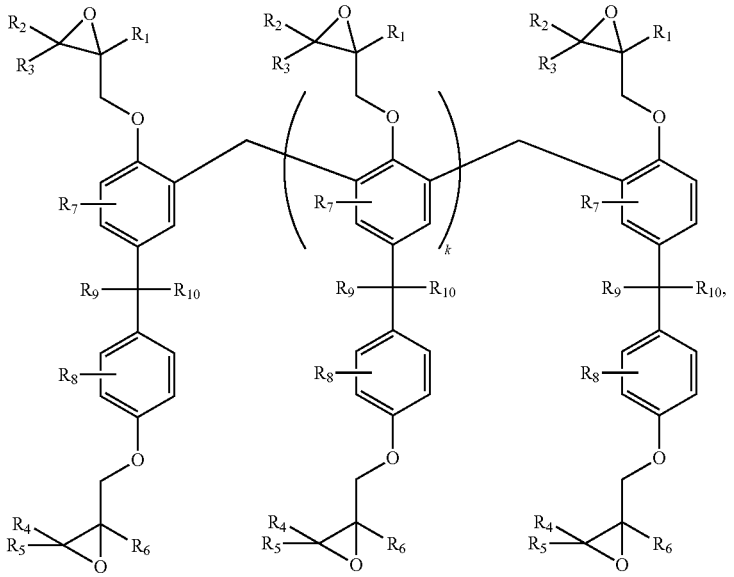

-continued

Formula 2

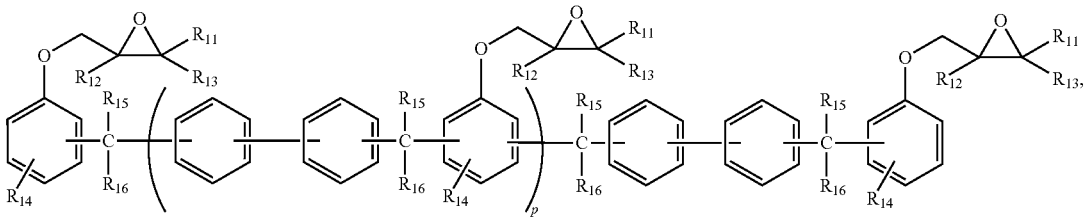

Formula 3

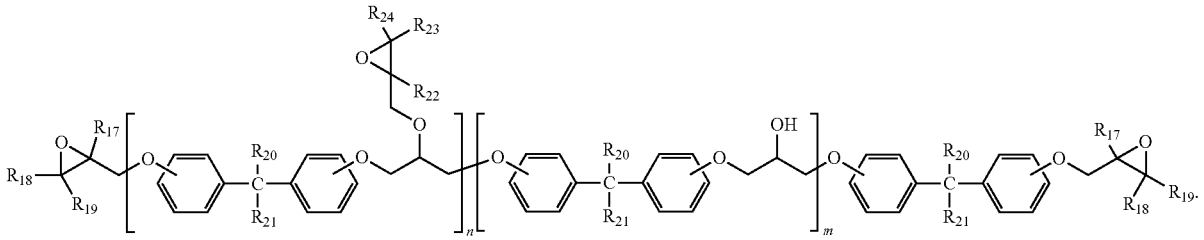

In Formula 1, 2, and 3: k, p, n and m are each independently an integer of 1 to 30; and $R_1$ to $R_{24}$ are each independently a hydrogen atom, a halogen atom, a hydroxyl group, an amino group, a nitro group, a cyano group, a substituted or unsubstituted $C_1$-$C_{20}$ alkyl group, a substituted or unsubstituted $C_1$-$C_{20}$ carboxyl group, a substituted or unsubstituted $C_1$-$C_{20}$ alkylsiloxane group, a substituted or unsubstituted $C_1$-$C_{20}$ alkoxy group, a substituted or unsubstituted $C_2$-$C_{20}$ alkenyl group, a substituted or unsubstituted $C_2$-$C_{20}$ alkynyl group, a substituted or unsubstituted $C_1$-$C_{20}$ heteroalkyl group, a substituted or unsubstituted $C_6$-$C_{30}$ aryl group, a substituted or unsubstituted $C_7$-$C_{30}$ arylalkyl group, a substituted or unsubstituted $C_5$-$C_{30}$ heteroaryl group, or a substituted or unsubstituted $C_3$-$C_{30}$ heteroarylalkyl group.

According to another aspect of the present disclosure, there is provided an inkjet printhead as described herein, wherein the bisphenol-A novolac epoxy resin, the first epoxy resin, and the second epoxy resin may be represented by Formula 4, 5, and 6, respectively:

Formula 4

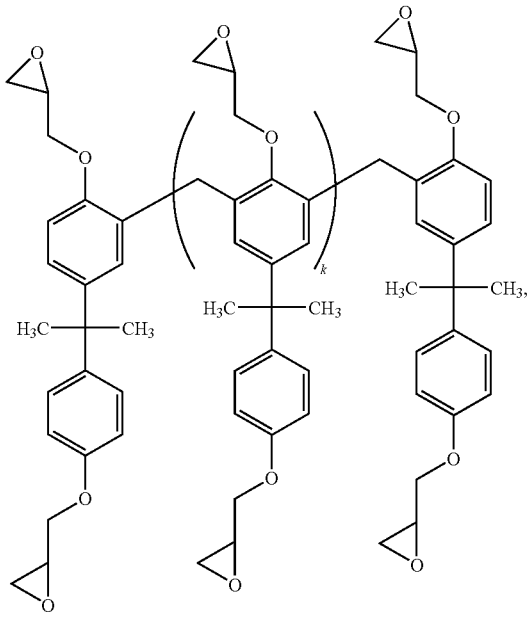

-continued

Formula 5

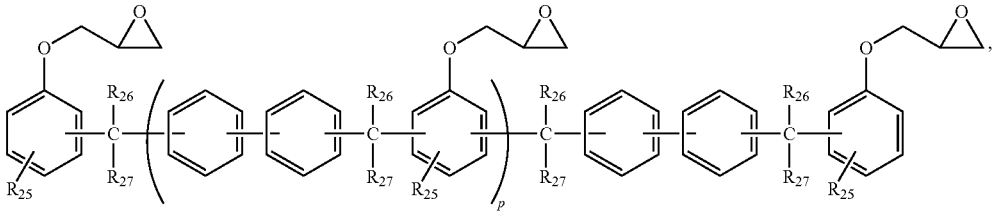

Formula 6

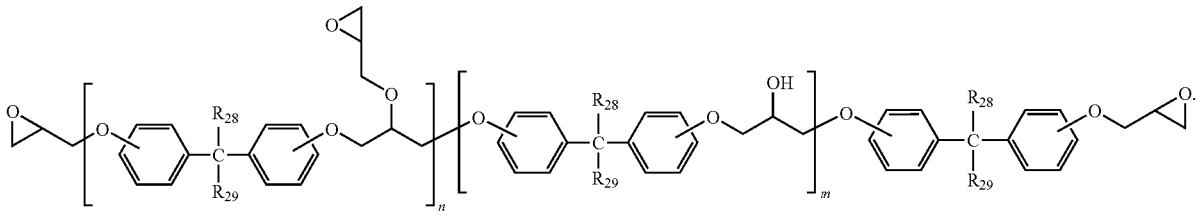

In Formula 4, 5, and 6: k, p, n and m are each independently an integer of 1 to 30; and $R_{25}$ to $R_{29}$ are each independently a hydrogen atom or a substituted or unsubstituted $C_1$-$C_{20}$ alkyl group.

According to another aspect of the present disclosure, there is provided an inkjet printhead as described herein, wherein the amount of the at least one epoxy resin selected from the first epoxy resin and the second epoxy resin may be from about 10 to about 1,900 parts by weight based on about 100 parts of the bisphenol-A novolac epoxy resin; the amount of the cationic photoinitiator is from about 0.1 to about 200 parts by weight based on about 100 parts of the bisphenol-A novolac epoxy resin; and the amount of solvent is from about 5 to about 2,000 parts by weight based on about 100 parts of the bisphenol-A novolac epoxy resin.

According to another aspect of the present disclosure, there is provided an inkjet printhead as described herein, wherein the inkjet printhead may further include: an insulating layer formed on the substrate; a plurality of heaters and electrodes sequentially formed on the insulating layer; and a passivation layer formed so as to cover the plurality of heaters and electrodes. The inkjet printhead described herein, may further include an anti-cavitation layer on the passivation layer.

According to another aspect of the present disclosure, there is provided a method of manufacturing an inkjet printhead, the method including the steps of: a) forming a chamber layer on a substrate; b) forming an ink feed hole on the substrate; c) forming a nozzle layer including a plurality of nozzles on the chamber layer; and d) forming an ink chamber and a restrictor through the ink feed hole, wherein the chamber layer and the nozzle layer are formed of cured products of a first negative photoresist composition and a second negative photoresist composition, wherein the first negative photoresist composition and the second negative photoresist composition include a bisphenol-A novolac epoxy resin represented by Formula 1; at least one epoxy resin selected from a first epoxy resin represented by Formula 2, and a second epoxy resin represented by Formula 3; a cationic photoinitiator; and a solvent, wherein Formula 1, 2, and 3 are as described herein.

According to another aspect of the present disclosure, there is provided a method of manufacturing an inkjet printhead, the method including the steps of: a) forming a chamber layer on a substrate; b) forming a nozzle layer including a plurality of nozzles on the chamber layer; c) forming an ink feed hole on the bottom surface of the substrate; and d) forming an ink chamber and a restrictor through the ink feed hole, wherein the chamber layer and the nozzle layer are respectively formed of cured products of a first negative photoresist composition and a second negative photoresist composition, wherein the first negative photoresist composition and the second negative photoresist composition include a bisphenol-A novolac epoxy resin represented by Formula 1; at least one epoxy resin selected from a first epoxy resin represented by Formula 2; and a second epoxy resin represented by Formula 3; a cationic photoinitiator; and a solvent, wherein Formula 1, 2, and 3 are as described herein.

A conventional inkjet printhead includes a glue layer, a chamber layer, and a nozzle layer. However, an inkjet printhead according to an embodiment of the present disclosure does not include the glue layer. Thus, the manufacturing process may be simplified, the manufacturing costs may be reduced, residue remaining on a heater after deposition may be removed in the preparation of the inkjet printhead including a chamber layer and a nozzle layer.

BRIEF DESCRIPTION OF THE DRAWINGS

Various aspects of the present disclosure will become apparent and more readily appreciated from the following description of the embodiments, taken in conjunction with the accompanying drawings, in which.

DETAILED DESCRIPTION OF SEVERAL EMBODIMENTS

Figure 1:
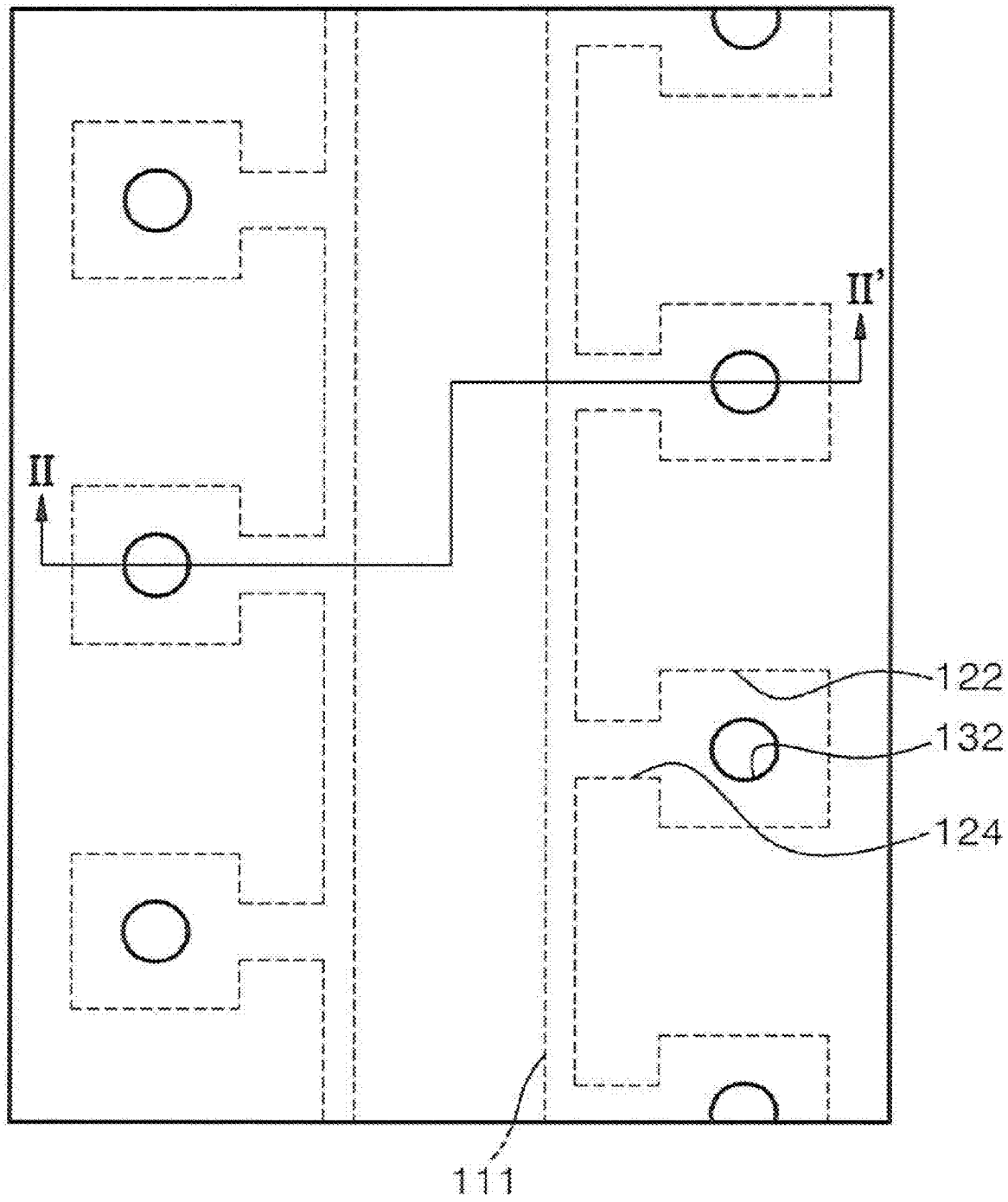
FIG. 1 is a schematic plan view of an inkjet printhead according to an embodiment of the present disclosure.

Several embodiments of the present disclosure are described below in detail with reference to the accompanying drawings, in which exemplary embodiments of the present disclosure are shown. In the drawings, like reference numerals denote like elements, and the size or the thickness of each element is not intended to be shown to true scale, and may be exaggerated for clarity. It will also be understood that when a layer is referred to as being on another layer or substrate, it can be directly on the other layer or substrate, or intervening layers may also be present.

Figure 2:
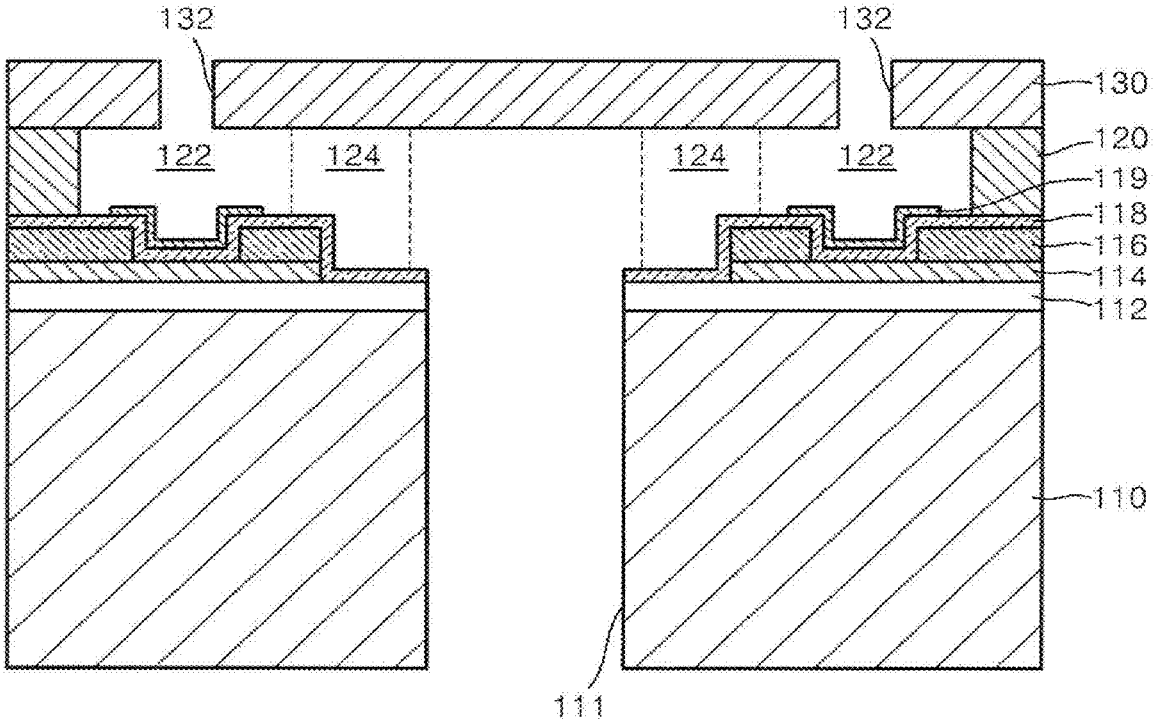
FIG. 2 is a cross-sectional view taken along line II-II of FIG. 1.

FIG. 1 is a schematic plan view of an inkjet printhead according to an embodiment of the present disclosure, whereas FIG. 2 is a cross-sectional view taken along line II-II of FIG. 1.

Referring to FIGS. 1 and 2, a chamber layer 120 and a nozzle layer 130 may be sequentially formed on a substrate 110 on which various material layers may be formed. The substrate 110 may be formed of silicon or any other suitable material. An ink feed hole 111 for supplying ink may be formed through the substrate 110.

An insulating layer 112 may be formed on the substrate 110 for heat and electrical insulation between the substrate 110 and heaters 114. The insulating layer 112 may be formed of a silicon oxide or any other suitable insulating material. The heater 114 is useful for generating ink bubbles by heating ink filled in an ink chamber 122, which may be formed on the insulating layer 112. The heater may be formed underneath the ink chamber 122. The heater 114 may be formed of a heating resistor material such as a tantalum-aluminum alloy, tantalum nitride, titanium nitride, or tungsten silicide, but is not limited thereto.

An electrode 116 may be placed on the top surface of the heater 114. The electrode 116 may be formed of a material having excellent electrical conductivity in order to supply current to the heater 114. The electrode 116 may be formed of aluminum (Al), an Al alloy, gold (Au), silver (Ag), or the like, but is not limited thereto.

A passivation layer 118 may be formed on the heater 114 and the electrode 116. The passivation layer 118 may be formed in order to prevent oxidization and corrosion of the heater 114 and the electrode 116 caused by the ink. The passivation layer 118 may be formed of a silicon nitride or a silicon oxide material, but is not limited thereto. The anti-cavitation layer 119 may further be formed on the passivation layer 118 positioned on the heaters 114. The anti-cavitation layer 119 may be formed in order to protect the heater 114 from a cavitation force generated when bubbles are extinguished, and may be formed of tantalum (Ta), but is not limited thereto.

The chamber layer 120 may be formed directly on the passivation layer. This is distinctive over the related art of forming a glue layer on the passivation layer 118 in order to increase the adhesion force between the chamber layer 120 and the passivation layer 118. Here, the glue layer is not required to be formed since the chamber layer may be formed of a cured product of a first negative photoresist composition, which has a low thermal expansion coefficient difference compared to the substrate and includes a bisphenol-A novolac epoxy resin represented by Formula 1 capable of relieving stress, and at least one epoxy resin selected from a first epoxy resin represented by Formula 2, and a second epoxy resin represented by Formula 3.

The chamber layer 120 formed of the first negative photoresist composition may be directly formed on the substrate 110 or on the passivation layer 118. The chamber layer 120 has a plurality of ink chambers 122 fillable with ink supplied from the ink feed hole 111. The chamber layer 120 may further include a plurality of restrictors 124 which connect the ink feed hole 111 and the ink chambers 122. The chamber layer 120 may be formed by forming a chamber material layer (120' of FIG. 4) including the first negative photoresist composition on the glue layer 121 and patterning the chamber material layer 120' by using a photolithography process.

The first negative photoresist composition may be formed of a negative-type photosensitive polymer. Since unexposed regions of the first negative photoresist composition may be removed by a developing solution, a plurality of ink chambers 122 and restrictors 124 may be formed. Exposed regions of the first negative photoresist composition may have a cross-linked structure due to a post exposure bake (PEB) process for forming the chamber layer 120.

A nozzle layer 130 may be formed of a second negative photoresist composition on the chamber layer 120. The nozzle layer 130 has a plurality of nozzles 132 through which ink may be ejected. The nozzle layer 130 may be formed by forming a nozzle material layer (130' of FIGS. 8 and 15) including the second negative photoresist composition on the chamber material layer 120 and patterning the nozzle material layer 130' using a photolithography process.

The second negative photoresist composition may be formed of a negative-type photosensitive polymer. Since unexposed regions of the second negative photoresist composition are removed by a developing solution, a plurality of nozzles 132 may be formed. Exposed regions of the second negative photoresist composition have a cross-linked structure due to a PEB process for forming the nozzle layer 130. The formation of the chamber layer 120 and the nozzle layer 130 will be described herein with reference to a method of manufacturing an inkjet printhead.

The first and second negative photoresist compositions used herein may include a prepolymer, i.e., bisphenol-A novolac epoxy resin, having a glycidyl ether functional group in a monomer repeating unit, and a bisphenol-A backbone; at least one epoxy resin selected from a first epoxy resin and a second epoxy resin; a cationic photoinitiator; and a solvent. In particular, the first and second negative photoresist compositions may be the same or different.

The prepolymer contained in the first and second negative photoresist compositions may form a cross-linked polymer by being exposed to actinic rays.

The bisphenol-A novolac epoxy resin, the first epoxy resin, and the second epoxy resin may be represented by Formula 1, 2, and 3, respectively.

Formula 1

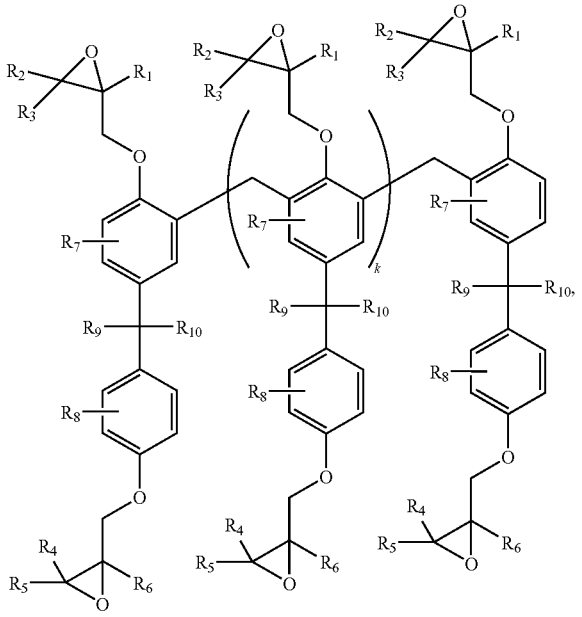

Formula 2

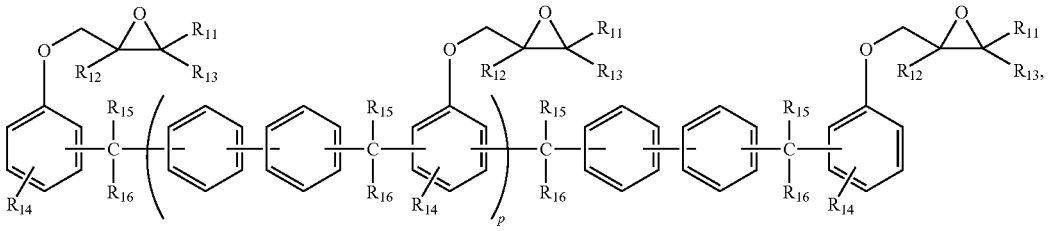

Formula 3

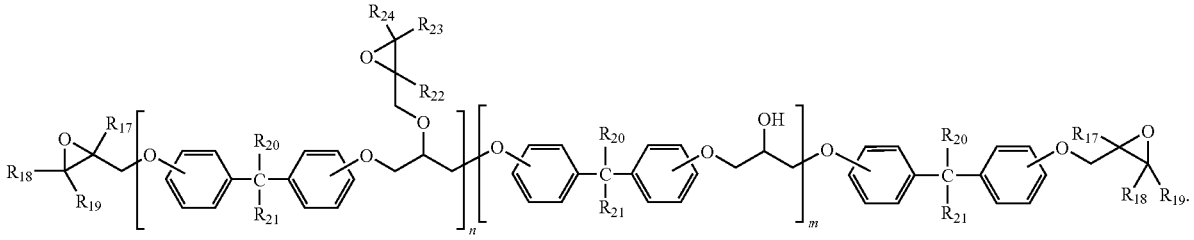

In Formula 1, 2, and 3: k, p, n and m are each independently an integer of 1 to 30; $R_1$ through $R_{24}$ are each independently a hydrogen atom, a halogen atom, a hydroxyl group, an amino group, a nitro group, a cyano group, a substituted or unsubstituted $C_1$-$C_{20}$ alkyl group, a substituted or unsubstituted $C_1$-$C_{20}$ carboxyl group, a substituted or unsubstituted $C_1$-$C_{20}$ alkylsiloxane group, a substituted or unsubstituted $C_1$-$C_{20}$ alkoxy group, a substituted or unsubstituted $C_2$-$C_{20}$ alkenyl group, a substituted or unsubstituted $C_2$-$C_{20}$ alkynyl group, a substituted or unsubstituted $C_1$-$C_{20}$ heteroalkyl group, a substituted or unsubstituted $C_6$-$C_{30}$ aryl group, a substituted or unsubstituted $C_7$-$C_{30}$ arylalkyl group, a substituted or unsubstituted $C_5$-$C_{30}$ heteroaryl group, or a substituted or unsubstituted $C_3$-$C_{30}$ heteroarylalkyl group.

In particular, the bisphenol-A novolac epoxy resin, the first epoxy resin and the second epoxy resin may be represented by Formula 4, 5 and 6, respectively:

Formula 4

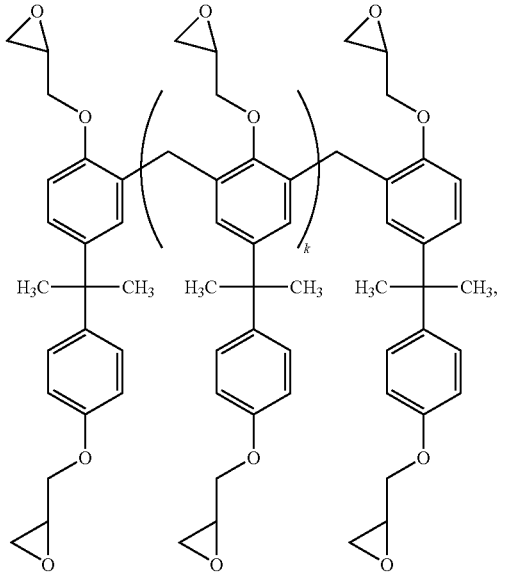

Formula 5

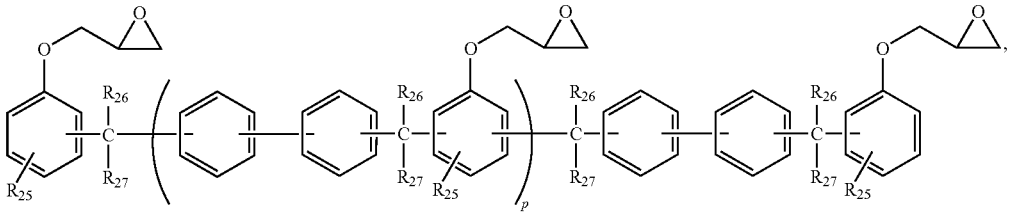

Formula 6

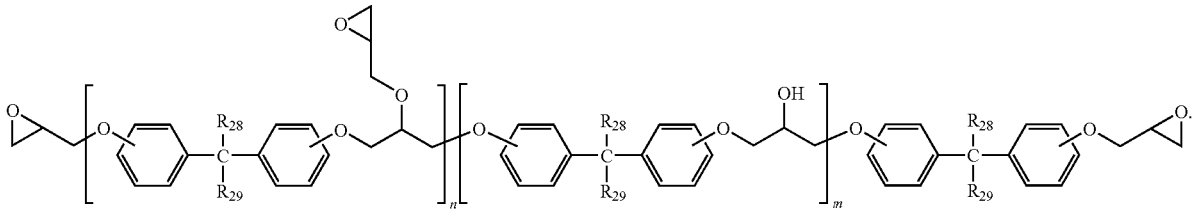

In Formula 4, 5, and 6: k, p, n and m are each independently an integer of 1 to 30; and $R_{25}$ to $R_{29}$ may be hydrogen atom, or a substituted or unsubstituted $C_1$-$R_{20}$ alkyl group.

The bisphenol-A novolac epoxy resin may be efficiently cross-linked by a strong acid catalyst due to its high functionality and branching properties. In addition, due to its high transparency at a wavelength ranging from 350 to 450 nm, even a thick film formed of the bisphenol-A novolac epoxy resin may have uniform illumination.

A cured product of a photoresist composition only including the bisphenol-A novolac epoxy resin however, may easily break, and cracks may easily occur. Thus, the adhesion force between the cured product and the substrate may be reduced. In order to increase the adhesive force, a glue layer may be interposed between the chamber layer and the substrate. However, materials used to form the glue layer are limited, and an additional process for forming the glue layer is required in addition to the process for forming the chamber layer and the nozzle layer. Thus, costs for manufacturing the inkjet printhead may increase.

In contrast, the inkjet printhead according to the present disclosure includes the chamber layer formed on the substrate using a negative photoresist composition further including at least one epoxy resin selected from the first epoxy resin represented by Formula 2, and the second epoxy resin represented by Formula 3 in addition to the bisphenol-A novolac epoxy resin. That is, the adhesion force between the chamber layer formed of a cured product of the photoresist composition and the substrate may increase even though the glue layer is not used. Since the first epoxy resin and second epoxy resin are flexible and have an excellent adhesive force to the surface of metal, which is distinctive from the bisphenol-A novolac epoxy resin, they may offset friability and cracks which may be caused by the bisphenol-A novolac epoxy resin.

The bisphenol-A novolac epoxy resin may be Epicoat 157 manufactured by Japan Epoxy Resin Co. Ltd. or EPON SU-8 manufactured by Resolution Performance Products, but is not limited thereto. The bisphenol-A novolac epoxy resin may be a reaction resultant between a bisphenol-A novolac resin and epichlorohydrin. The bisphenol-A novolac resin may be prepared by condensation reaction between a bisphenol-A-based compound and an aldehyde-based and/or ketone-based compound in the presence of an acidic catalyst.

The bisphenol-A compound may be represented by Formula 7:

Formula 7

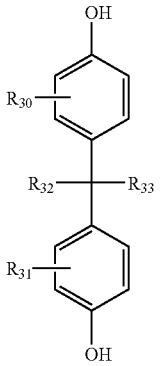

In Formula 7, $R_{30}$ through $R_{33}$ are each independently a hydrogen atom, a halogen atom, a hydroxyl group, an amino group, a nitro group, a cyano group, a substituted or unsubstituted $C_1$-$C_{20}$ alkyl group, a substituted or unsubstituted $C_1$-$C_{20}$ carboxyl group, a substituted or unsubstituted $C_1$-$C_{20}$ alkylsiloxane group, a substituted or unsubstituted $C_1$-$C_{20}$ alkoxy group, a substituted or unsubstituted $C_2$-$C_{20}$ alkenyl group, a substituted or unsubstituted $C_2$-$C_{20}$ alkynyl group, a substituted or unsubstituted $C_1$-$C_{20}$ heteroalkyl group, a substituted or unsubstituted $C_6$-$C_{30}$ aryl group, a substituted or unsubstituted $C_7$-$C_{30}$ arylalkyl group, a substituted or unsubstituted $C_5$-$C_{30}$ heteroaryl group, or a substituted or unsubstituted $C_3$-$C_{30}$ heteroarylalkyl group.

The aldehyde-based compound may be formaldehyde, formalin, p-formaldehyde, trioxane, acetaldehyde, propylaldehyde, benzaldehyde, phenylacetaldehyde, alpha-phenylpropylaldehyde, beta-phenylpropylaldehyde, o-hydroxybenzaldehyde, m-hydroxybenzaldehyde, p-hydroxybenzaldehyde, o-chlorobenzaldehyde, m-chlorobenzaldehyde, p-chlorobenzaldehyde, o-methylbenzaldehyde, m-methylbenzaldehyde, p-methylbenzaldehyde, p-ethylbenzaldehyde, p-n-butylbenzaldehyde, terephthalic acid aldehyde, and the like, or combinations there of.

The ketone-based compound may be acetone, methyl ethyl ketone, diethyl ketone, diphenyl ketone, and the like, or combinations there of.

The first epoxy resin may be NC-3000 epoxy resin or NC-3000H epoxy resin manufactured by Nippon Kayaku Co., Ltd., but is not limited thereto.

The second epoxy resin may be NER-7403 epoxy resin, NER-7604 epoxy resin, NER-1302 epoxy resin, or NER-7516 epoxy resin manufactured by Nippon Kayaku Co., Ltd., but is not limited thereto.

According to another aspect of the present disclosure, there is provided an inkjet printhead as described herein, wherein the amount of the at least one epoxy resin selected from the first epoxy resin and the second epoxy resin may be from about 10 to about 1,900 parts by weight based on about 100 parts of the bisphenol-A novolac epoxy resin; the amount of the cationic photoinitiator is from about 0.1 to about 200 parts by weight based on about 100 parts of the bisphenol-A novolac epoxy resin; and the amount of solvent is from about 5 to about 2,000 parts by weight based on about 100 parts of the bisphenol-A novolac epoxy resin.

If the amount of the at least one epoxy resin selected from the first epoxy resin and the second epoxy resin is less than about 10 parts by weight, the adhesive force between the chamber layer and the nozzle layer using the negative photoresist composition may decrease. If the amount of the at least one epoxy resin selected from first epoxy resin and the second epoxy resin is greater than about 1,900 parts by weight, the effects of the first epoxy resin or the second epoxy resin may be negligible even though the manufacturing costs increase.

The cationic photoinitiator contained in the first and second negative photoresist compositions according to the present disclosure may be a compound capable of generating ions or free radicals that initiate polymerization by being exposed to light. Examples of the cationic photoinitiator are an aromatic halonium salt or an aromatic sulfonium salt of elements of Groups VA and VI. The aromatic halonium salt may be an aromatic iodonium salt. Examples of the aromatic iodonium salt are diphenyliodonium tetrafluoroborate, diphenyliodonium hexafluoroantimonate, and butylphenyliodonium hexafluoroantimonate (SP-172), but are not limited thereto. Examples of the aromatic sulfonium salt are triphenylsulfonium tetrafluoroborate, triphenylsulfonium hexafluoroantimonate (UVI-6974), phenylmethylbenzylsulfonium hexafluoroantimonate, phenylmethylbenzylsulfonium hexafluorophosphate, triphenylsulfonium hexafluorophosphate, methyl diphenylsulfonium tetrafluoroborate, and dimethyl phenylsulfonium hexafluorophosphate. The cationic photoinitiator may include UVI-6974, manufactured by Union Carbide Corporation, SP-172, manufactured by Asahi Denka Co., Ltd., Cyracure 6974, manufactured by Dow Chemicals Co., or the like.

The amount of the cationic photoinitiator may be from about 0.1 to about 200 parts by weight, about 1 to about 160 parts by weight, or about 2 to about 120 parts by weight based on about 100 parts by weight of the bisphenol-A novolac epoxy resin. When the amount of the cationic photoinitiator is less than about 0.1 parts by weight, a cross-linking reaction may not sufficiently occur. On the other hand, when the amount of the cationic photoinitiator is greater than about 200 parts by weight, photoenergy requirements may be increased, and thus, the cross-linking rate may be reduced.

The solvent used in the first and second negative photoresist compositions according to the present disclosure may include α-butyrolactone, γ-butyrolactone, propylene glycol methyl ethyl acetate, tetrahydrofuran, methyl ethyl ketone, methyl isobutyl ketone, cyclopentanone, or xylene, or combinations thereof.

The amount of the solvent may be from about 5 to about 2,000 parts by weight, about 5 to about 1,800 parts by weight, or about 10 to about 1,700 parts by weight based on about 100 parts by weight of the bisphenol-A novolac epoxy resin. When the amount of the solvent is less than about 5 parts by weight, viscosity of the produced polymer may be so high that workability may decrease. On the other hand, when the amount of the solvent is greater than about 2,000 parts by weight, viscosity of the produced negative photoresist composition may be so low that patterns may not be formed.

The negative photoresist composition may further include a plasticizer. The plasticizer may prevent cracks generated in the nozzle layer after developing the nozzles during the formation of the nozzles and removing a sacrificial layer. In addition, defects of an image caused by spacing may be prevented by reducing the variation of the overall inclination of the nozzles. A plasticizer having a high boiling point lubricates the cross-linked polymers to reduce stress of the nozzle layer. The use of the plasticizer may simplify the manufacturing process by omitting an additional baking process. Phthalic acid, trimellitic acid, or phosphite may be used as the plasticizer. Examples of the phthalic acid plasticizer are dioctyl phthalate (DOP) and diglycidyl hexahydro phthalate (DGHP), but are not limited thereto. The trimellitic acid plasticizer may be triethylhexyl trimellitate, and the phosphite plasticizer may be tricresyl phosphate, but are also not limited thereto. These compounds may be used alone or in combination.

The amount of the plasticizer may be from about 1 to about 15 parts by weight, or about 5 to about 10 parts by weight based on about 100 parts by weight of the epoxidized multifunctional bisphenol B novolac resin. If the amount of the plasticizer is less than about 1 part by weight, the effects of the plasticizer may decrease. If the amount of the plasticizer is greater than about 15 parts by weight, the cross-linking density of the prepolymer may decrease.

The first and second negative photoresist compositions may further include additives such as an epoxy resin, a reactive monomer, an adhesive intensifier, an organic aluminum compound, a photointensifier, a filler, a viscosity modifier, a wetting agent, and a photostabilizer. The amount of each of the additives may be from about 0.1 to about 20 parts by weight based on about 100 parts by weight of the bisphenol-A novolac epoxy resin.

The additional epoxy resin may be used to control a lithography contrast of a photoresist film or change absorbance of a photoresist film according to its structure. The additional epoxy resin may have an epoxide equivalent weight ranging from 150 to 250 grams per resin equivalent of epoxide. The epoxy resin may be epoxy cresol-novolac resin, cycloaliphatic epoxide, or the like. The epoxy cresol-novolac resin may be EOCN-4400 epoxy resin manufactured by Nippon Kayaku Co., Ltd. The cycloaliphatic epoxide may be EHPE-3150 epoxy resin manufactured by Daicel Chemical Industries, Ltd.

The reactive monomer may be added to the negative photoresist composition to increase flexibility of the cured product. The reactive monomer may include at least two glycidyl ether groups, and may be diethylene glycol diglycidyl ether, propylene glycol diglycidyl ether, polypropylene glycol diglycidyl ether, hexanediol diglycidyl ether, trimethylolpropane triglycinyl ether, or pentaerythritol tetraglycidyl ether. The glycidyl ethers may be used alone or in combination.

The adhesive intensifier may be 3-glycidoxypropyltrimethoxysilane, 3-glycidoxypropyltriethoxysilane, 3-mercaptopropyltrimethoxysilane, vinyltrimethoxysilane, [3-(methacryloyloxy)propyl]trimethoxysilane, or the like.

The organic aluminum compound may absorb ionic materials, as an ion generating component, allowing the cured product to remain. The organic aluminum compound may be used to reduce toxic effects of ions derived from the cationic photoinitiator. The organic aluminum compound may be an alkoxyaluminum compound such as tris-methoxyaluminum, tris-ethoxyaluminum, tris-isopropoxyaluminum, isopropoxydiethoxyaluminum and tris-butoxyaluminum, a phenoxyaluminum compound such as tris-phenoxyaluminum and tris-paramethylphenoxyaluminum, and tris-acetoxyaluminum, tris-aluminum stearate, tris-aluminum butylate, tris-aluminum propionate, tris-aluminum acetylacetonate, tris-aluminum tolyl fluoroacetylacetate, tris-aluminum ethyl acetoacetate, aluminum diacetylacetonatodipivaloymethanate, aluminum diisopropoxy(ethyl acetoacetate), or the like. The organic aluminum compounds may be used alone or in combination.

The photointensifier absorbs energy from light and facilitates energy transmission to another compound to form a radical or an ionic photoinitiator. The photointensifier expands the wavelength range of energy effective for exposure, and may be an aromatic chromophore that absorbs light. In addition, the photointensifier may induce the formation of radicals or ionic photo initiators.

The alkyl group used as a substituent in the compounds of the present embodiment may be a straight or branched $C_1$-$C_{20}$ alkyl group, a straight or branched $C_1$-$C_{12}$ alkyl group, or a straight or branched $C_1$-$C_6$ alkyl group. Examples of the unsubstituted alkyl group include but are not limited to methyl, ethyl, n-propyl, isopropyl, n-butyl, isobutyl, sec-butyl, t-butyl, pentyl, iso-amyl, hexyl, etc. Optionally, at least one hydrogen atom of the alkyl group may be substituted with a halogen atom, a hydroxyl group, —SH, a nitro group,

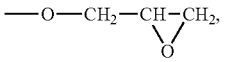

a cyano group, a substituted or unsubstituted amino group (—$NH_2$, —NH(R), —N(R')(R"), wherein R' and R" are each independently $C_1$-$C_{10}$ alkyl group, an amidino group, a hydrazine group, a hydrazone group, a carboxyl group, a sulfonic acid group, a phosphate group, a $C_1$-$C_{20}$ alkyl group, a $C_1$-$C_{20}$ alkyl group halogenated alkyl group, a $C_1$-$C_{20}$ alkenyl group, a $C_1$-$C_{20}$ alkynyl group, a $C_1$-$C_{20}$ heteroalkyl group, a $C_6$-$C_{20}$ aryl group, a $C_6$-$C_{20}$ arylalkyl group, a $C_6$-$C_{20}$ heteroaryl group, or a $C_6$-$C_{20}$ heteroarylalkyl group.

The cycloalkyl group used as a substituent in the compounds of the present embodiment may be a monovalent monocyclic system having 3 to 20 carbon atoms, 3 to 10 carbon atoms, or 3 to 6 carbon atoms. In the cycloalkyl group, optionally at least one hydrogen atom may be substituted with such substituents as having been described with reference to the alkyl group.

The heterocycloalkyl group used herein refers to a monovalent monocyclic system containing 3-20 carbon atoms, 3-10 carbon atoms, or 3-6 carbon atoms, and one, two, or three heteroatoms selected from N, O, P, and S. Optionally, at least one hydrogen atom of the heterocycloalkyl group may be substituted with the same substituent as in the alkyl group described herein.

The alkoxy group used as a substituent in the compound of the present embodiment may be an oxygen-containing straight or branched alkoxy group having a $C_1$-$C_{20}$ alkyl moiety, a $C_1$-$C_6$ alkoxy group, or a $C_1$-$C_3$ alkoxy group. The alkoxy group may be methoxy, ethoxy, propoxy, butoxy, and t-butoxy and the like. The alkoxy group may be optionally substituted at least one halogen atom such as fluorine, chlorine, or bromine to form a haloalkoxy group. The haloalkoxy group may be fluoromethoxy, chloromethoxy, trifluoromethoxy, trifluoroethoxy, fluoroethoxy, and fluoropropoxy. Optionally, at least one hydrogen atom of the alkoxy group may be substituted by the same substituents as recited in the above definition of the alkyl group.

The alkenyl group used as a substituent in the compound of the present embodiment may be a straight or branched $C_1$-$C_{20}$ aliphatic hydrocarbon group including a carbon-carbon double bond. For example, the alkenyl group includes 2 to 12 carbon atoms, or 2 to 6 carbon atoms. The branched alkenyl group optionally includes at least one lower alkyl or alkenyl group attached to a straight alkenyl group. The alkenyl group may be unsubstituted or substituted by at least one group selected from halo, carboxy, hydroxy, formyl, sulfo, sulfino, carbamoyl, amino and imino. The alkenyl group may also be substituted by other groups. Examples of the alkenyl group include ethenyl, propenyl, carboxyethenyl, carboxypropenyl, sulfinoethenyl and sulfonoethenyl. Optionally, at least one hydrogen atom of the alkenyl group may be substituted by the same substituents as recited in the above definition of the alkyl group.

The alkynyl group used as a substituent in the compound of the present embodiment may be a straight or branched $C_2$-$C_{20}$ aliphatic hydrocarbon group including a carbon-carbon triple bond. The alkenyl group may have 2 to 12 carbon atoms, or 2 to 6 carbon atoms. The branched alkynyl group optionally includes at least one lower alkyl or alkynyl group attached to a straight alkynyl group. The alkenyl group may be unsubstituted or substituted by at least one group selected from halo, carboxy, hydroxy, formyl, sulfo, sulfino, carbamoyl, amino and imino. The alkenyl group may also be substituted by other groups. Optionally, at least one hydrogen atom of the alkynyl group may be substituted by the same substituents as recited in the above definition of the alkyl group.

The heteroalkyl group used as a substituent in the compound of the present embodiment may be an alkyl group including a backbone having 1 to 20, 1 to 12, or 1 to 6 carbon atoms and a hetero atom, e.g., N, O, P, S, or the like. Optionally, at least one hydrogen atom of the heteroalkyl group may be substituted by the same substituents as recited in the above definition of the alkyl group.

The aryl group used as a substituent in the compound of the present embodiment may be used alone or in a combination, and is a $C_{6-30}$ carbocyclic aromatic system including one or more rings. The rings may be attached or fused together using a pendent method. The aryl group may include an aromatic radical such as phenyl, naphthyl, tetrahydronaphthyl, indane, and biphenyl. Optionally, at least one hydrogen atom of the aryl group may be substituted by the same substituents as recited in the above definition of the alkyl group.

The arylalkyl group used as a substituent in the compound of the present disclosure may be an alkyl group, in which optionally at least one hydrogen atom of the alkyl group is substituted with the aryl group.

The heteroaryl group used as a substituent in the compound of the present embodiment may be a monovalent monocyclic or bicyclic aromatic radical including 1, 2, or 3 heteroatoms selected from N, O, and S, and 5 to 30 carbon atoms. In addition, the heteroaryl group refers to a monovalent monocyclic or bicyclic aromatic radical in which optionally at least one of the heteroatoms is oxidized or quaternarized to form, for example, an N-oxide or a quaternary salt. The heteroaryl group may be thienyl, benzothienyl, pyridyl, pyrazinyl, pyrimidinyl, pyridazinyl, quinolinyl, quinoxalinyl, imidazolyl, furanyl, benzofuranyl, thiazolyl, isooxazolyl, benzisoxazolyl, benzimidazolyl, triazolyl, pyrazolyl, pyrrolyl, indolyl, 2-pyridonyl, N-alkyl-2-pyridonyl, pyrazinonyl, pyridazinonyl, pyrimidinonyl, oxazolonyl, and corresponding N-oxides thereof (e.g., pyridyl N-oxide and quinolinyl N-oxide), and quaternary salts thereof, but is not limited thereto. Optionally, at least one hydrogen atom of the heteroaryl group may be substituted with the same substituent as in the alkyl group described herein.

The heteroarylalkyl used as a substituent in the compound of the present embodiment may be a carbocyclic aromatic system having 3 to 30 carbon atoms in which optionally at least one hydrogen atom is substituted with the same substituents as recited in the above definition of the alkyl group. Optionally, at least one hydrogen atom of the heteroarylalkyl group may be substituted by the same substituents as recited in the above definition of the alkyl group.

Two types of methods of manufacturing the inkjet printhead are described as follows. The first type of method of manufacturing the inkjet printhead includes the steps of: a) forming a chamber layer on a substrate; b) forming an ink feed hole on the substrate; c) forming a nozzle layer including a plurality of nozzles on the chamber layer; and d) forming an ink chamber and a restrictor through the ink feed hole, wherein the chamber layer and the nozzle layer are respectively formed of cured products of a first negative photoresist composition and a second negative photoresist composition, wherein the first negative photoresist composition and the second negative photoresist composition include a bisphenol-A novolac epoxy resin represented by Formula 1; at least one epoxy resin selected from a first epoxy resin represented by Formula 2 and a second epoxy resin represented by Formula 3; a cationic photoinitiator; and a solvent, wherein Formula 1, 2 and 3 are as described herein.

According to the first type, the ink feed hole may be formed by processing the upper surface of the substrate 110 before forming the nozzle layer. Thus, the upper surface of the ink feed hole may be accurately formed, and the ink may uniformly flow from the ink feed hole to each of the ink chambers.

FIGS. 3 to 10 are cross-sectional views for describing a method of manufacturing an inkjet printhead according to another embodiment of the present disclosure.

Figure 3:
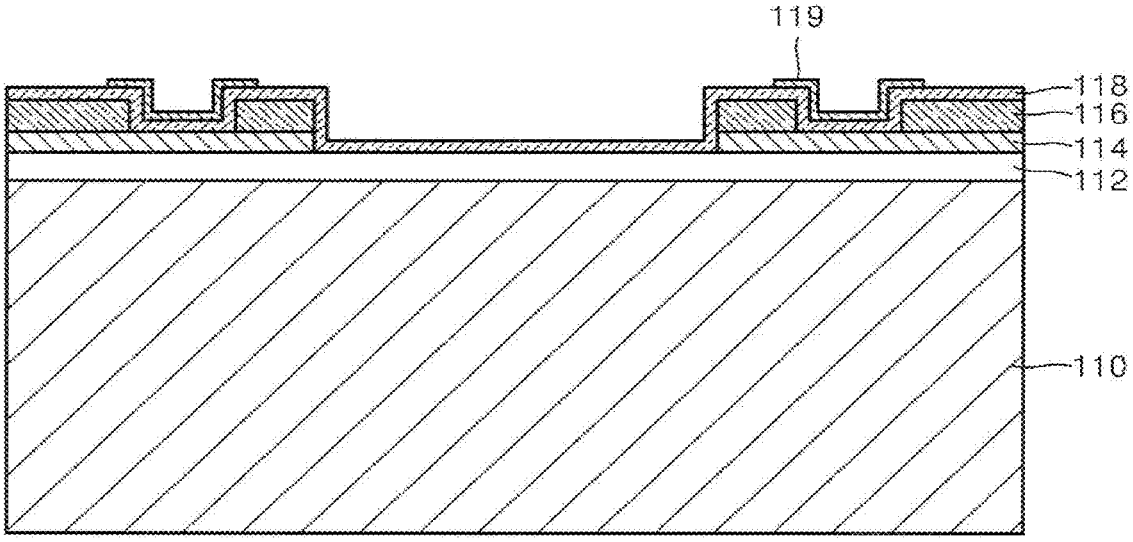
FIGS. 3 to 10 are cross-sectional views for describing a method of manufacturing an inkjet printhead, according to another embodiment of the present disclosure.

Referring to FIG. 3, a substrate 110 is prepared, and an insulating layer 112 may be formed on the substrate 110. The substrate 110 may be a silicon substrate but is not limited thereto. The insulating layer 112 may be formed for insulation between the substrate 110 and heaters 114 and may be formed of a silicon oxide or other suitable material. The heaters 114 for generating ink bubbles by heating the ink may be formed on the insulating layer 112. The heaters 114 may be formed by depositing a heating resistor material, such as a tantalum-aluminum alloy, a tantalum nitride, a titanium nitride, or a tungsten silicide or other suitable materials, on the insulating layer 112 and patterning the heating resistor. A plurality of electrodes 116, for supplying current to the heaters 114, may be formed on the heaters 114. The electrodes 116 may be formed by depositing a metal having excellent electrical conductivity, such as aluminum (Al), an Al alloy, gold (Au), or silver (Ag), on the heaters 114, and then patterning the metal.

A passivation layer 118 may be formed on the insulating layer 112 so as to cover the heaters 114 and the electrodes 116. The passivation layer 118 may be formed in order to prevent oxidization and corrosion of the heaters 114 and the electrodes 116 caused by ink, and may be formed of a silicon nitride or a silicon oxide material.

A photosensitive resin-containing glue layer (not shown) including the photoresist may also be formed on the passivation layer 118 in order to increase the adhesion force between the chamber material layer 120' and the passivation layer 118.

An anti-cavitation layer 119 may further be formed on the passivation layer 118 positioned on the heaters 114. The anti-cavitation layer 119 protects its corresponding heater 114 from a cavitation force generated when bubbles pop, and may be formed of tantalum (Ta) or any other suitable materials.

Figure 4:
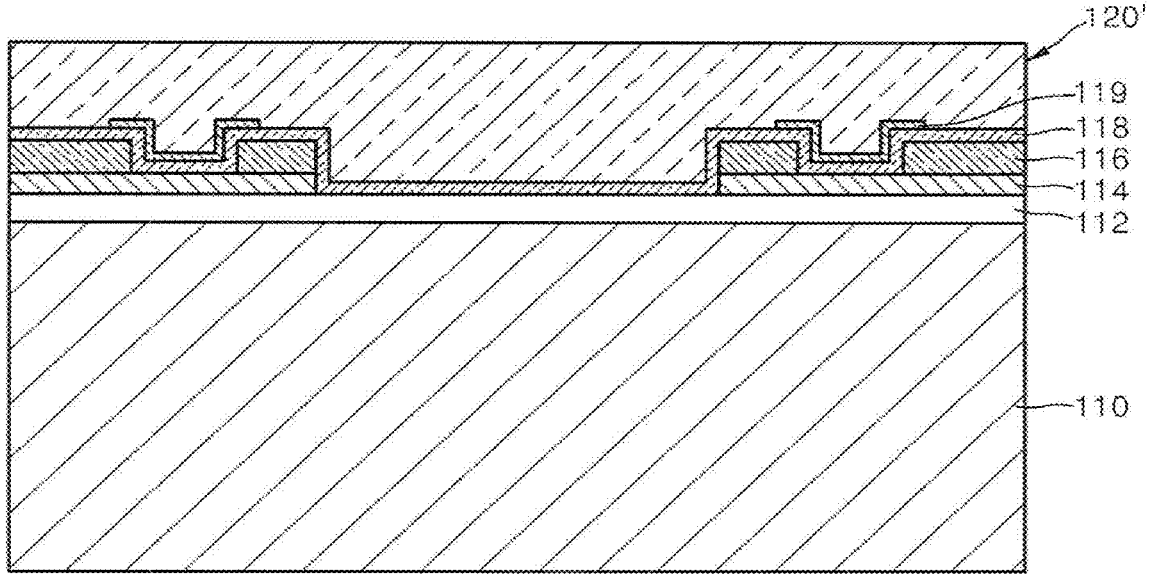

Referring to FIG. 4, the chamber material layer 120' may be formed on the passivation layer 118. The chamber material layer 120' includes a first negative photoresist composition, etc. The chamber material layer 120' may be formed by laminating a dry film including photoresist, a photo acid generator (PAG), etc., on the passivation layer 118. The photoresist used to form the chamber material layer 120' may be a negative type photosensitive polymer or the photoresist may be an alkali-soluble resin. Examples of the alkali-soluble resin are ANR manufactured by AZ Electronic Materials, SPS manufactured by Shinetsu Chemical Co., Ltd., and WPR manufactured by JSR Corporation, but are not limited thereto.

The chamber material layer 120' may be subjected to a light exposure process and a post exposure bake (PEB) process. In particular, the chamber material layer 120' may be exposed to light using a photomask (not shown) having an ink chamber pattern and a restrictor pattern.

Figure 5:
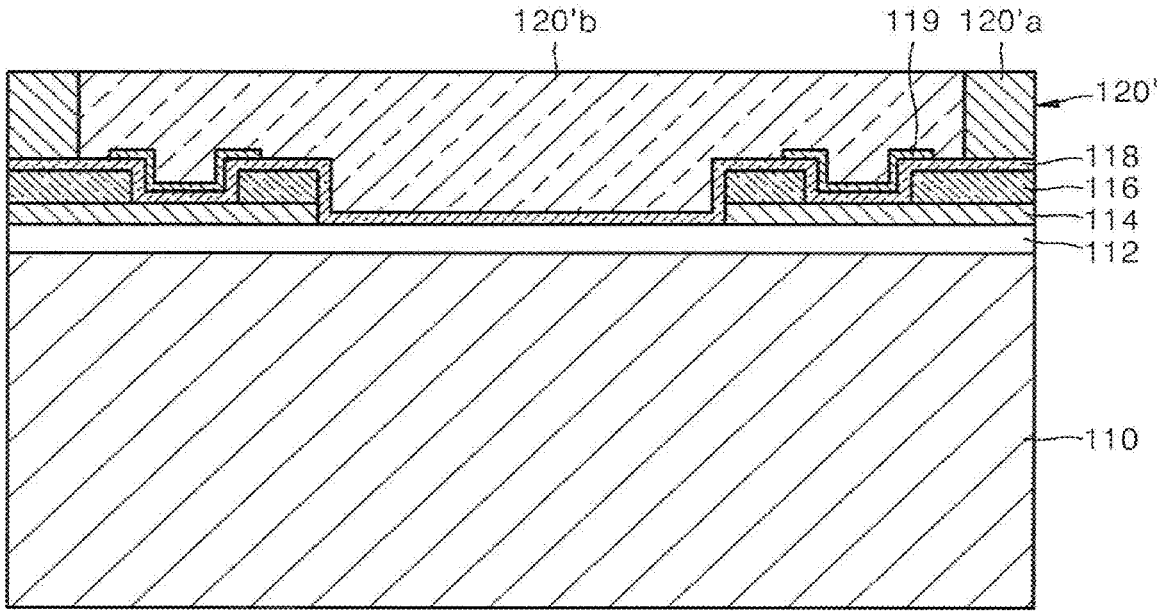
Figure 6:
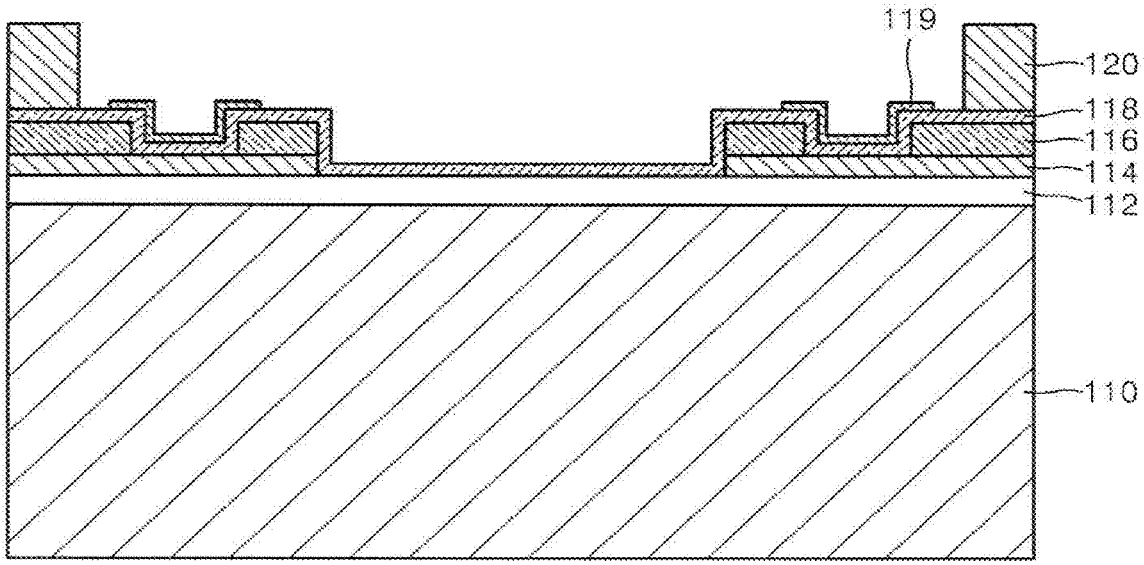

Referring to FIGS. 5 and 6, if the chamber material layer 120' includes a first negative photoresist composition, ions or free radicals that initiate polymerization may be generated by the exposure process in the exposed region 120' of the chamber material layer 120'. If the chamber material layer 120' includes a negative photoresist polymer, acids are generated by a photoacid generator (PGA) in the exposure process in the exposed region 120'*a* of the chamber material layer 120'.

The exposed chamber material layer 120' may be subjected to the PEB process. The PEB process may be conducted at a temperature ranging from about 90 to 120° C. for about 3 to 5 minutes. During the PEB process, a cross-linking reaction occurs in the exposed regions 120'*a* of the chamber material layer 120' to form a cross-linked first negative photoresist composition.

Referring to FIG. 5, the chamber material layer 120' may be subjected to a development process, after the light exposure process and the PEB process, to form a chamber layer 120. The unexposed regions 120*b*' of the chamber material layer 120' are removed by a developing solution during the development process. Since the first negative photoresist composition of the exposed regions 120'*a* of the chamber material layer 120' have a cross-linked structure formed by the PEB process, the exposed regions 120'*a* of the chamber material layer 120' are not removed by the development process but form the chamber layer 120.

Figure 7:
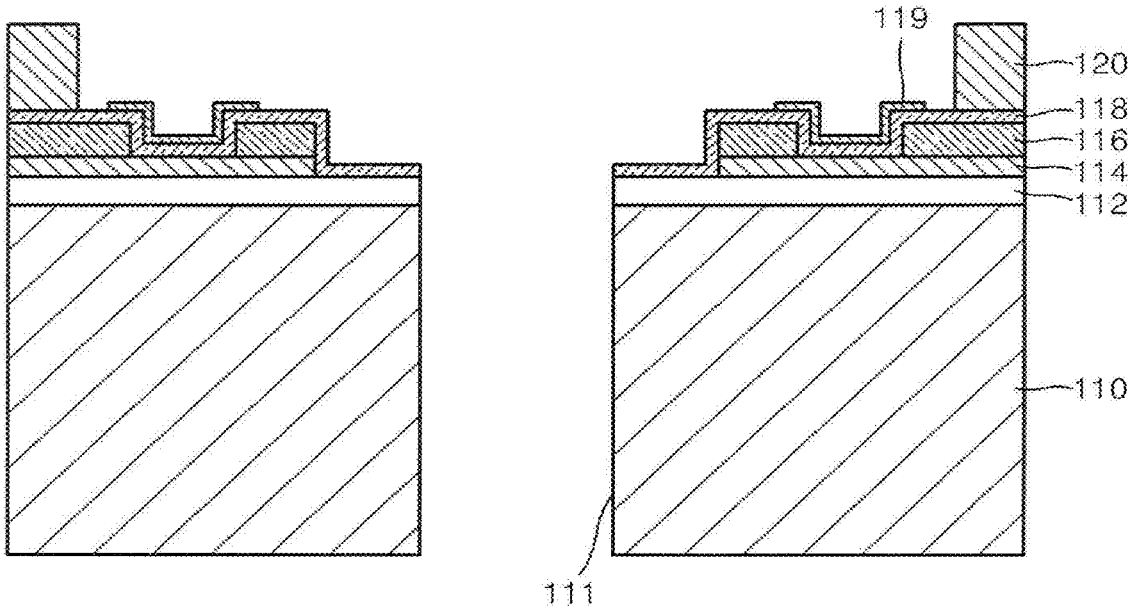

Referring to FIG. 7, an ink feed hole 111 for supplying ink may be formed in the substrate 110. The ink feed hole 111 may be formed by sequentially processing the passivation layer 118, the insulating layer 112, and the substrate 110. The ink feed hole 111 may be prepared by dry etching, wet etching, laser processing, or by various other processes. In the current embodiment, the ink feed hole 111 may be formed so as to penetrate the substrate 110 from the top surface to the bottom surface of the substrate 110.

The method may further include coating a photoresist on the bottom surface of the substrate 110 before etching the ink feed hole 111. That is, the photoresist may be coated on the bottom surface of the substrate 110 before etching the ink feed hole 111, and the photoresist developed on the chamber layer 120 to provide the pattern of the ink feed hole 111. The substrate 110 may be etched from the top surface of the substrate 110 by the depth of the substrate 110. The etching of the surface 110 may be stopped with photoresist coated on the bottom surface of the substrate 110, and the substrate 110 may be dipped in a solvent to remove the photoresist coated on the bottom surface of the substrate 110.

Figure 8:
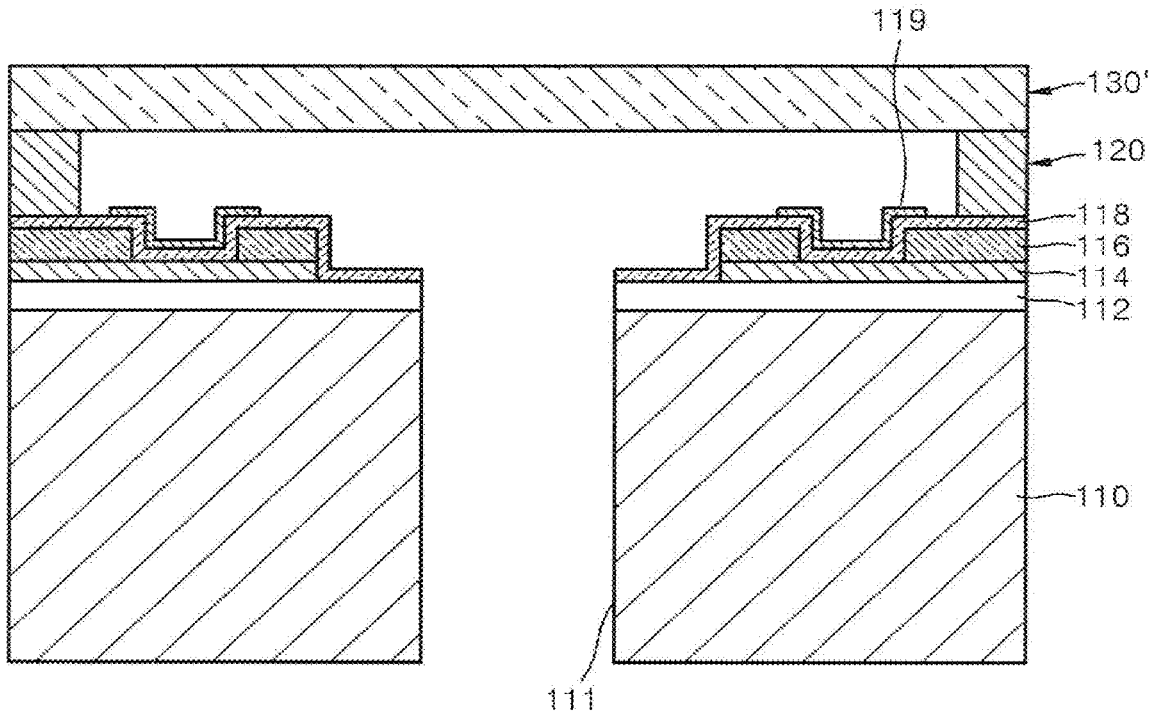

Referring to FIG. 8, the nozzle material layer 130' may be formed on the chamber layer 120. The nozzle material layer 130' may be formed by laminating a dry film prepared by removing the solvent in the second negative photoresist composition, on the chamber material layer 120'.

The ink feed hold may be formed on the substrate. This may allow the second negative photoresist composition to leak through the ink feed hold during the formation of the nozzle material layer using a liquid second negative photoresist composition. Thus, the nozzle material layer may not be efficiently prepared.

Figure 9:
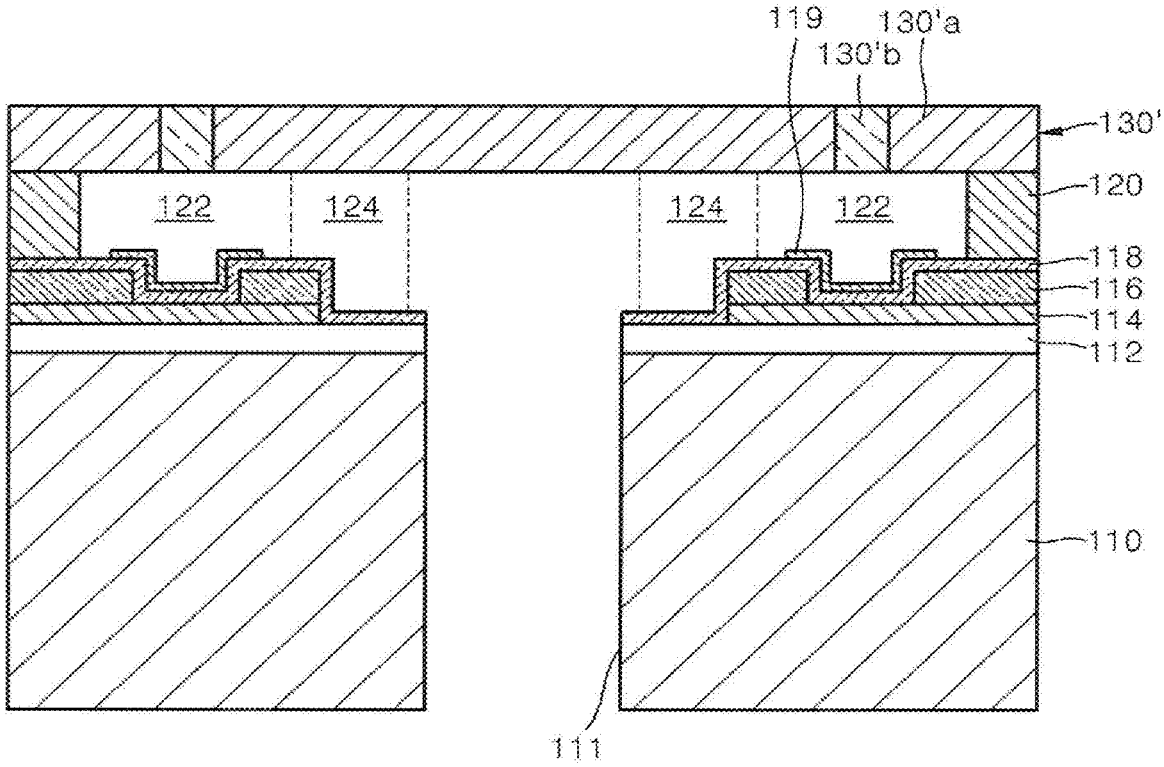
Figure 10:
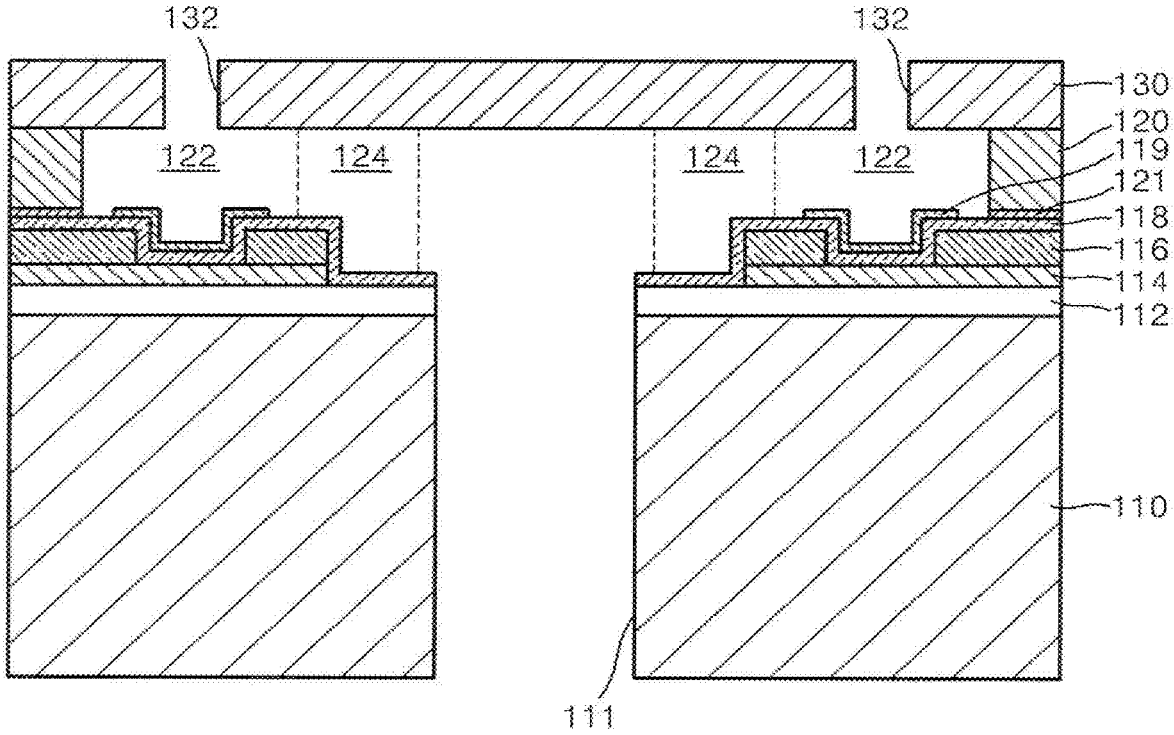

Referring to FIGS. 9 and 10, a process for forming the nozzle layer and the nozzle will be described. In particular, the nozzle material layer 130' is subjected to an exposure process. The nozzle material layer 130' may be exposed to light using a photomask (not shown) having a nozzle pattern. If the nozzle material layer 130' includes the second negative photoresist composition, ions or free radicals that initiate polymerization are generated by the cationic photoinitiator in the exposed region 130'*a* of the nozzle material layer 130' by the exposure process. The unexposed region 130'*b* of the nozzle material layer 130' is shown in FIG. 9.

The nozzle material layer 130' exposed to light may be subjected to a PEB process and a development process to form the nozzle layer 130 in FIG. 10. In particular, the nozzle material layer 130' may be subjected to a PEB process. The PEB process may be conducted at a temperature ranging from about 90 to 120° C. for about 3 to 5 minutes, but is not limited thereto. The second negative photoresist composition may be cross-linked in the exposed regions 130'*a* of the nozzle material layer 130' by the PEB process. The nozzle material layer 130' may be subjected to the development process. The unexposed regions 130'*b* of the nozzle material layer 130' may be removed with a predetermined developing solution by the development process to form a plurality of nozzles 132. Since the second negative photoresist composition contained in the exposed regions 130'*a* of the nozzle material layer 130' has a cross-linked structure due to the PEB process, the exposed regions 130'*a* of the nozzle material layer 130' may not removed by the development process, and thus, form the nozzle layer 130. As a result, as shown in FIG. 10, ink chambers 122 and restrictors 124 surrounding the chamber layer 120 may be formed.

A second type of method of manufacturing the inkjet printhead includes the steps of: a) forming a chamber layer on a substrate; b) forming a nozzle layer including a plurality of nozzles on the chamber layer; c) forming an ink feed hole on the bottom surface of the substrate; and d) forming an ink chamber and a restrictor through the ink feed hole, wherein the chamber layer and the nozzle layer are respectively formed of cured products of a first negative photoresist composition and a second negative photoresist composition, wherein the first negative photoresist composition and the second negative photoresist composition include a bisphenol-A novolac epoxy resin represented by Formula 1; at least one epoxy resin selected from a first epoxy resin represented by Formula 2; and a second epoxy resin represented by Formula 3; a cationic photoinitiator; and a solvent, wherein Formula 1, 2 and 3 are as described herein.

According to the second type, the ink feed hole may be formed from the top surface to the bottom surface of the substrate after forming the chamber layer and the nozzle layer on the substrate. Since the nozzle material layer may be formed in the absence of the ink feed hole, the negative photoresist composition may be used in a liquid state, or a dry film of the negative photoresist composition may be used.

Figure 11:
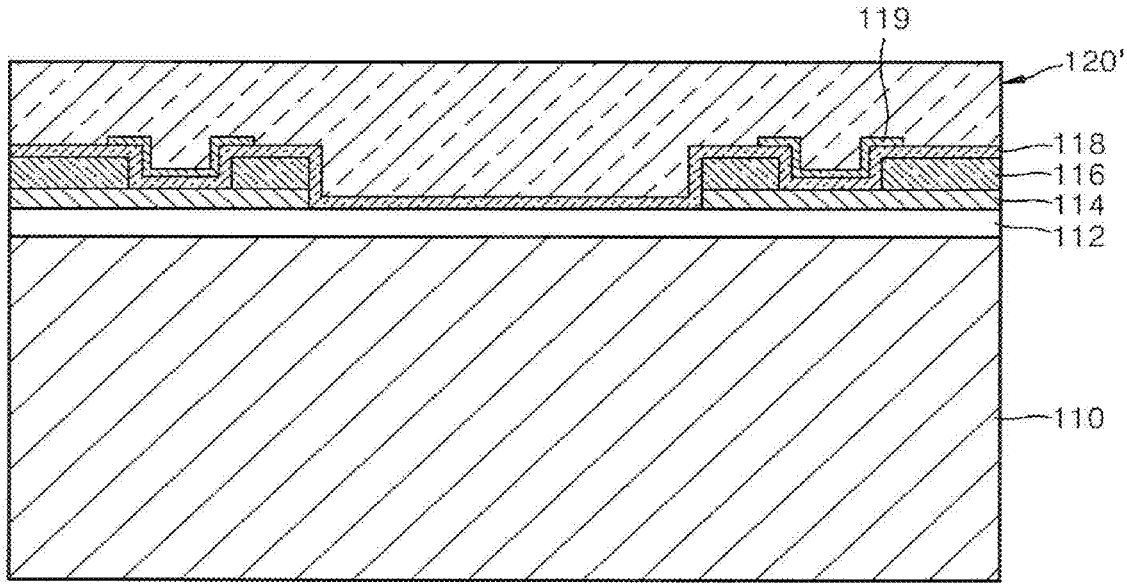
FIGS. 11 to 21 are cross-sectional views for describing a method of manufacturing an inkjet printhead, according to another embodiment of the present disclosure.
Figure 12:
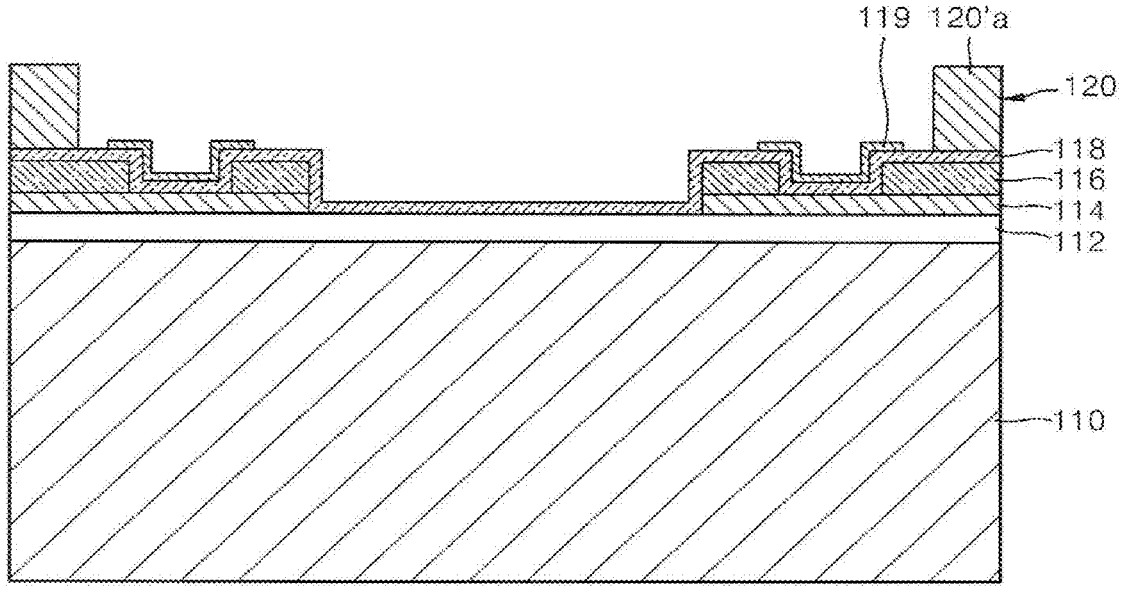

FIGS. 11 to 21 are cross-sectional views for describing a method of manufacturing an inkjet printhead according to another embodiment of the present disclosure. Referring to FIGS. 11 and 12, as shown in FIGS. 3 to 6, the insulating layer 112, the heaters 114, the plurality of electrodes 116, the passivation layer 118, and the anti-cavitation layer 119 may be selectively formed on the substrate 110. The chamber material layer 120' may be formed on the passivation layer 118 using the first negative photoresist composition, and the chamber material layer 120' may be subjected to an exposure process, a PEB process, and a development process to form the chamber layer 120.

Figure 13:
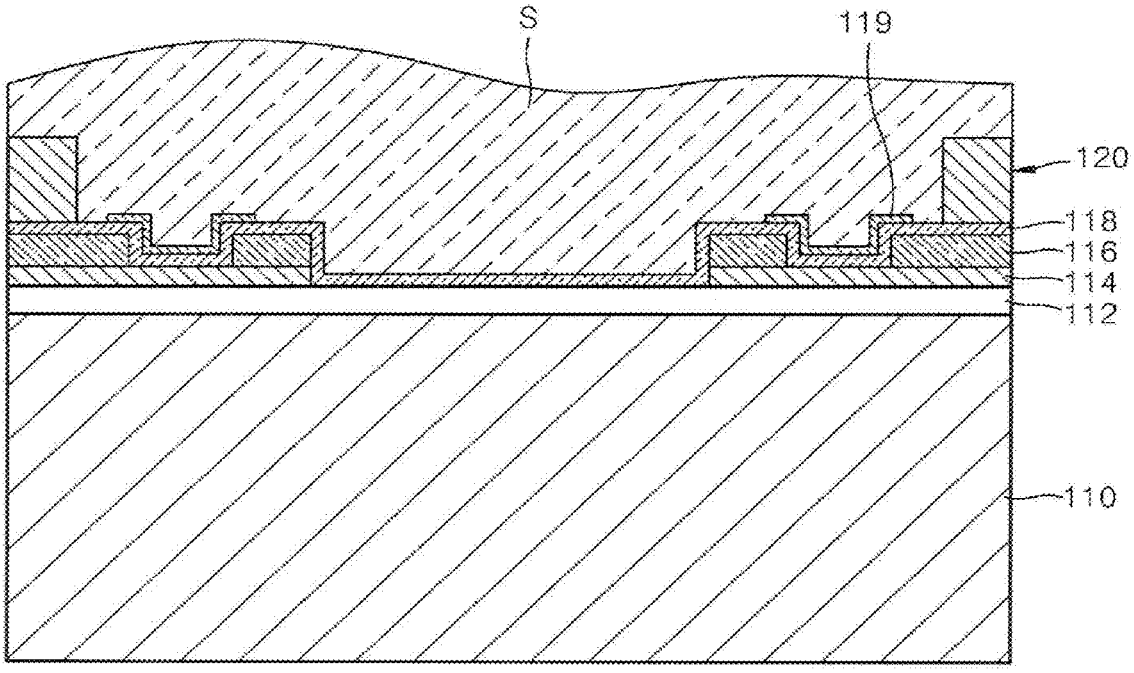

Referring to FIG. 13, a sacrificial layer S may be formed on the chamber layer 120, which may be subjected to the light exposure process and the PEB process, and the height of the sacrificial layer S is greater than that of the chamber layer 120. The sacrificial layer S may be formed by coating positive photoresist or a non-photosensitive soluble polymer to a predetermined thickness on the substrate 110 using a spin coating process. Here, the positive photoresist may be imide-based positive photoresist. If the imide-based positive photoresist is used for the sacrificial layer S, the sacrificial layer S is not affected by the solvent and nitrogen gas is not generated even upon exposure. For this, the imide-based positive photoresist may be subjected to hard baking at about 140° C. Also, the sacrificial layer S may be formed by coating liquid non-photosensitive soluble polymer to a predetermined thickness on the substrate 110 using a spin coating process, and baking the non-photosensitive soluble polymer. Here, the non-photosensitive soluble polymer may include at least one polymer resin selected from a phenol resin, a polyurethane resin, an epoxy resin, a polyimide resin, an acrylic resin, a polyamide resin, a urea resin, a melamine resin, and a silicon resin.

Figure 14:
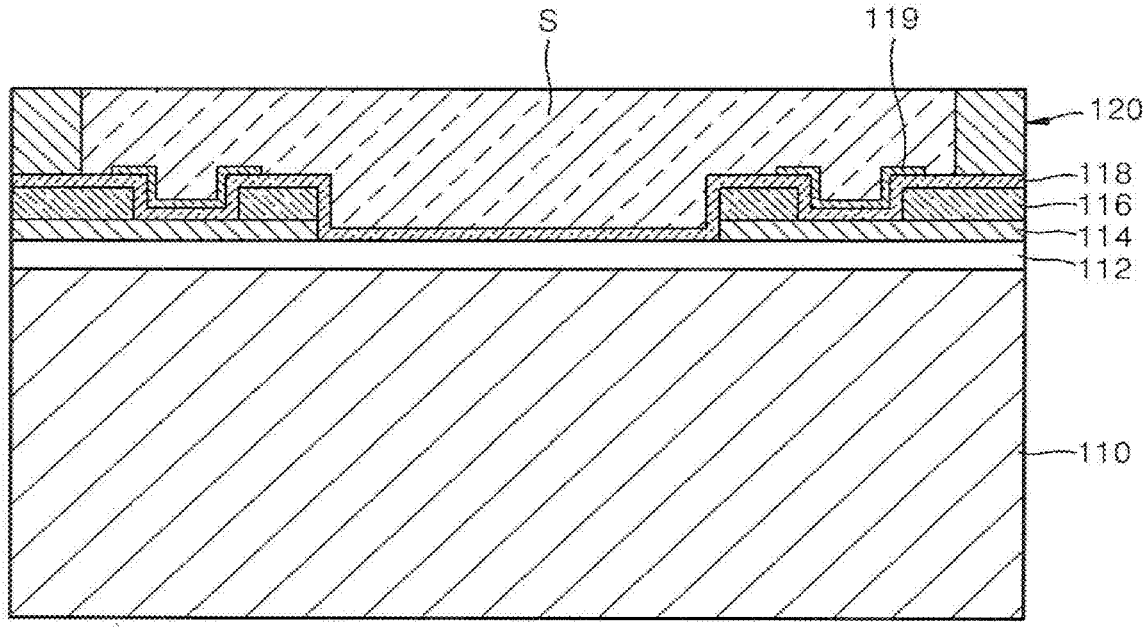

The chamber layer 120 and the sacrificial layer S may be planarized using a chemical mechanical polishing (CMP) process as shown in FIG. 14. In more detail, the top surfaces of the sacrificial layer S and the chamber layer 120 may be polished using the CMP process to a desired height of the ink passage so that the top surfaces of the chamber layer 120 and the sacrificial layer S are formed at the same height.

Figure 15:
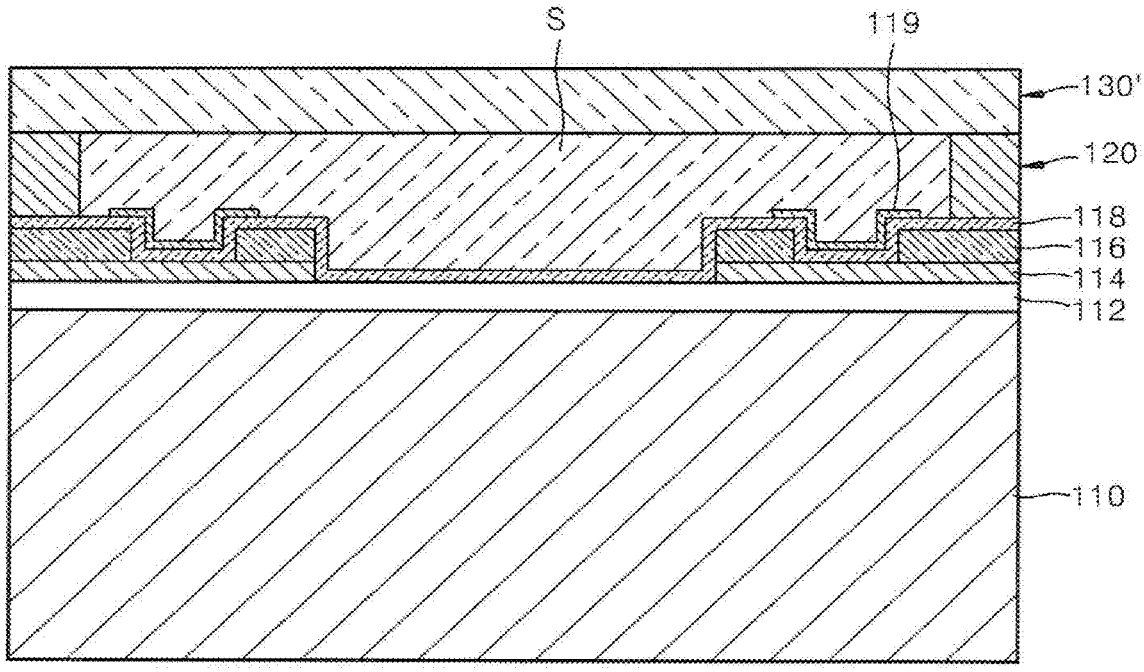

Referring to FIG. 15, a nozzle material layer 130' may be formed on the chamber layer 120 and the sacrificial layer S. The nozzle material layer 130' includes a second negative photoresist composition, etc. The nozzle material layer 130' may be formed by laminating a dry film including photoresist, a photo acid generator (PAG), etc., on the chamber layer 120. The photoresist contained in the nozzle material layer 130' may be a negative type photosensitive polymer.

Figure 16:
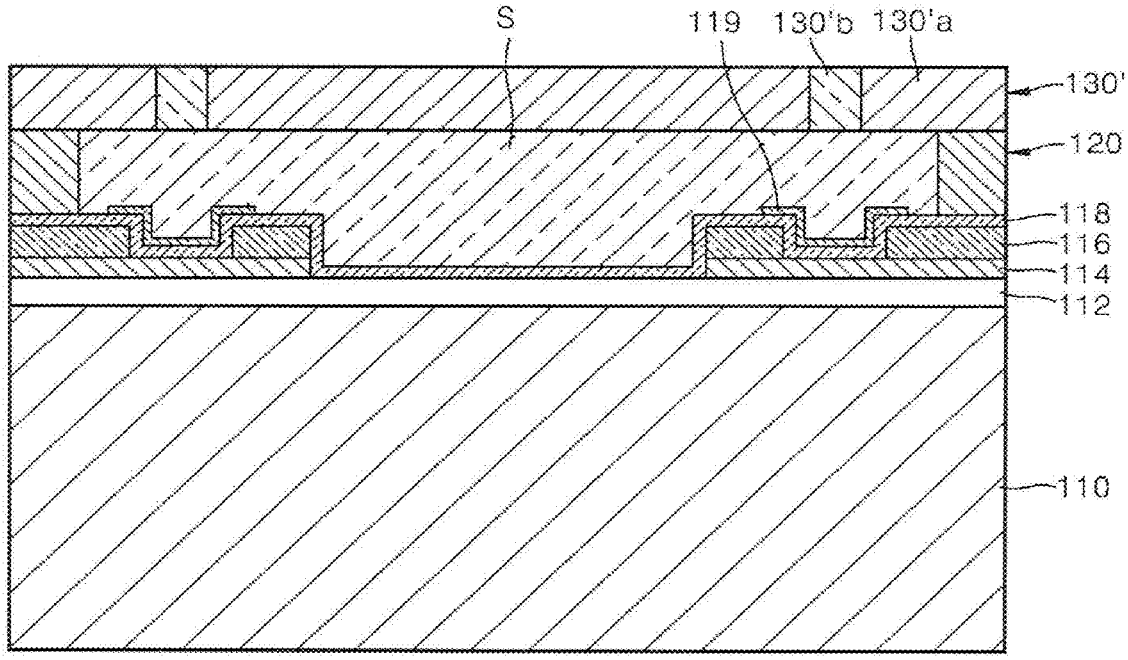
Figure 17:
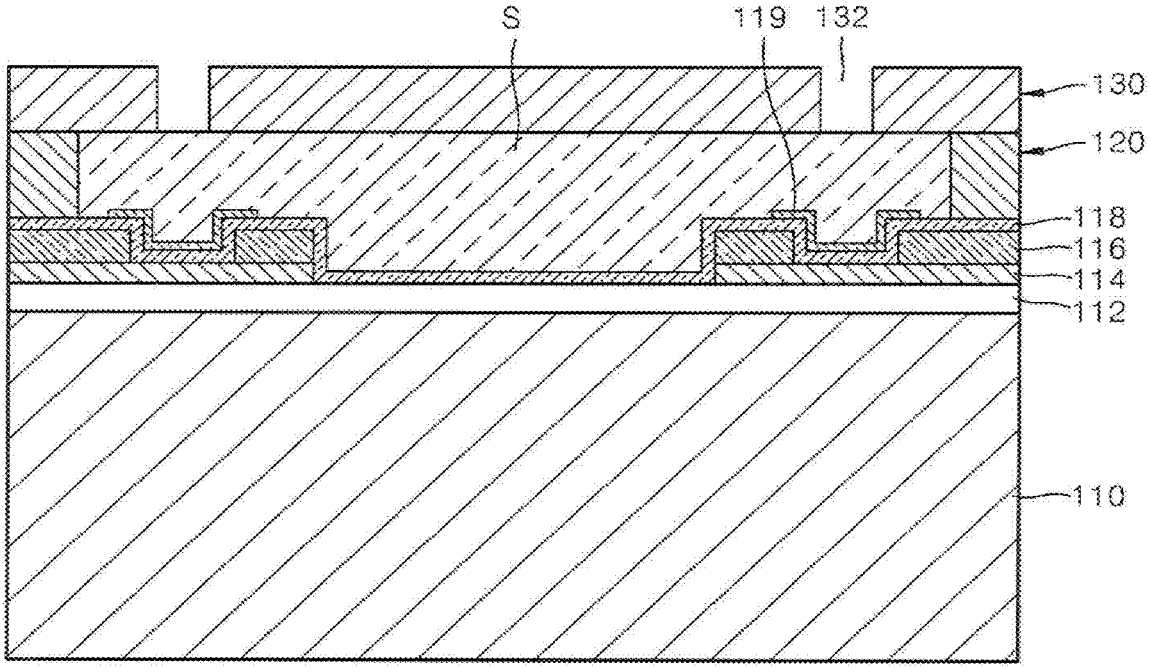

Referring to FIGS. 16 and 17, the process for forming the nozzle layer and the nozzle will be described. In particular, the nozzle material layer 130' may be subjected to an exposure process. The nozzle material layer 130' may be exposed to light using a photomask (not shown) having a nozzle pattern. If the nozzle material layer 130' includes the second negative photoresist composition, ions or free radicals that initiate polymerization may be generated by the exposure process in the exposed region 130'*a* of the chamber material layer 130'. If the nozzle material layer 130' includes a negative photoresist polymer, acids are generated by a photoacid generator (PGA) by the exposure process in the exposed region 130'*a* of the nozzle material layer 130'. The unexposed region 130'*b* of the nozzle material layer 130' is shown in FIG. 16.

The nozzle material layer 130' exposed to light is subjected to a PEB process and a development process to form a nozzle layer 130 in FIG. 17. In particular, the nozzle material layer 130' may be subjected to a PEB process. The PEB process may be conducted at a temperature ranging from about 90 to 120° C. for about 3 to 5 minutes, but is not limited thereto. The second negative photoresist composition may be cross-linked in the exposed regions 130'*a* of the nozzle material layer 130' by the PER process. The nozzle material layer 130' may be subjected to the development process. The unexposed regions 130'*b* of the nozzle material layer 130' may be removed with a predetermined developing solution by the development process to form a plurality of nozzles 132. Since the second negative photoresist composition contained in the exposed regions 130'*a* of the nozzle material layer 130' has a cross-linked structure due to the PEB process, the exposed regions 130'*a* of the nozzle material layer 130' may not be removed by the development process, and thus, form the nozzle layer 130.

The photoresist may be developed on the chamber layer to form the pattern of the ink feed hole, and the substrate 100 may be etched by 10 to 20% of the depth of the substrate 100 before selectively forming the sacrificial layer S on the chamber layer 120. Since the ink feed hole may be partially formed on the desired position of the top surface of the substrate, the ink feed hole may have a uniform shape. The diameter of the etched ink feed hole may be the same as or different from the diameter of the ink feed hole formed on the bottom surface of the substrate.

Figure 18:
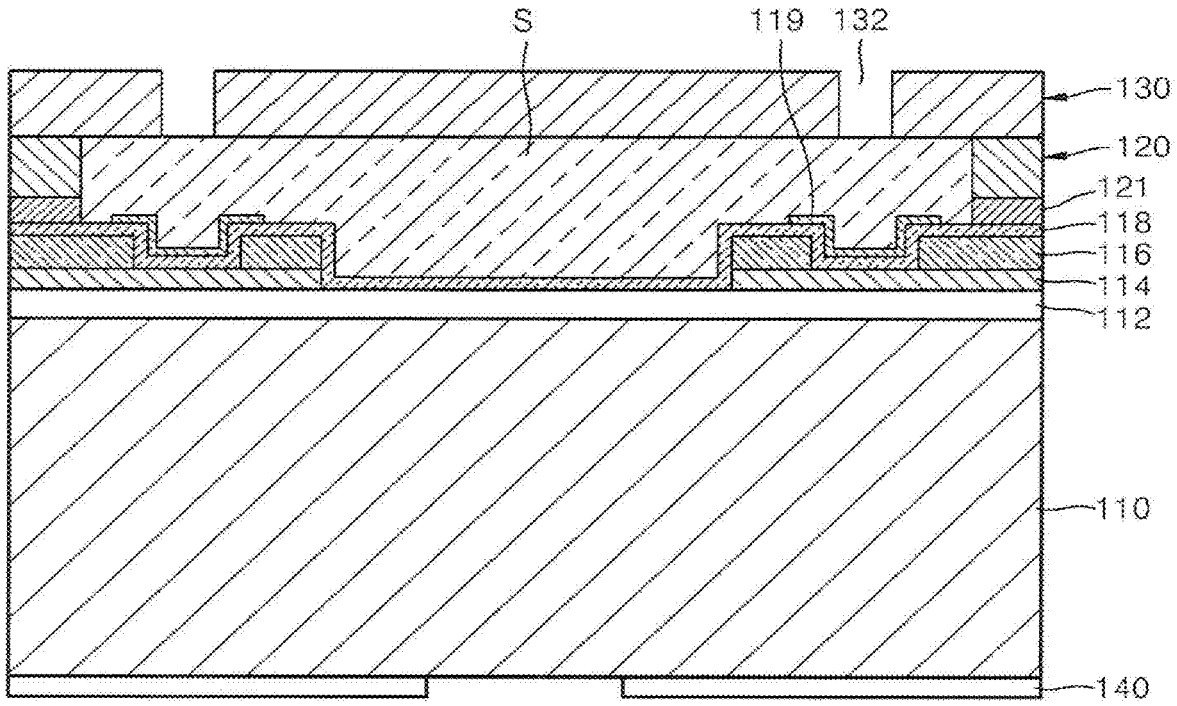

The etch mask 140 for forming the ink feed hole 111 (FIG. 19) may be formed on the bottom surface of the substrate 110, as shown in FIG. 18. The etch mask 140 may be formed by coating a positive or negative photoresist on the bottom surface of the substrate 110 and patterning the photoresist.

Figure 19:
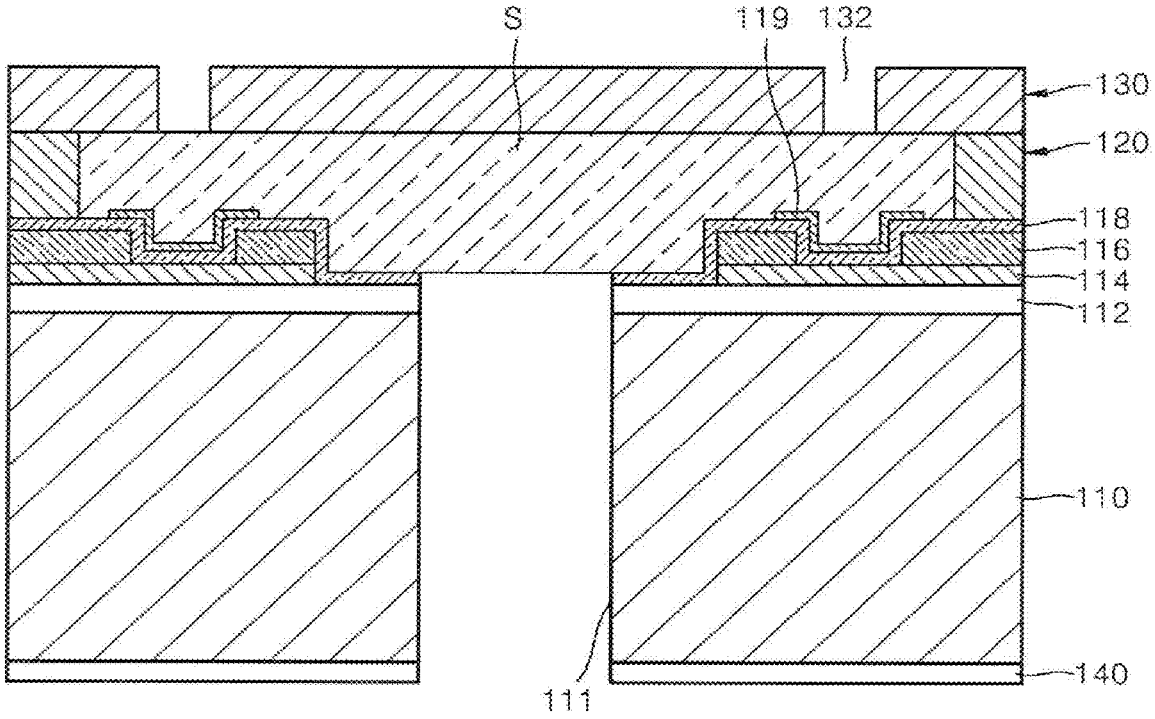
Figure 20:
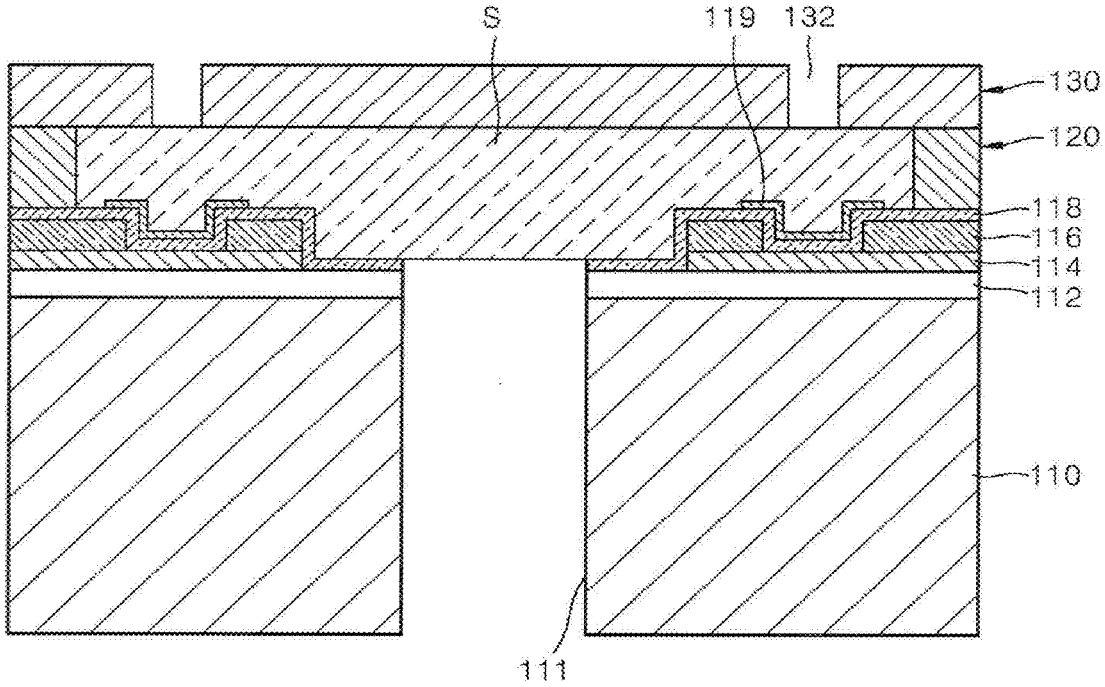
Figure 21:
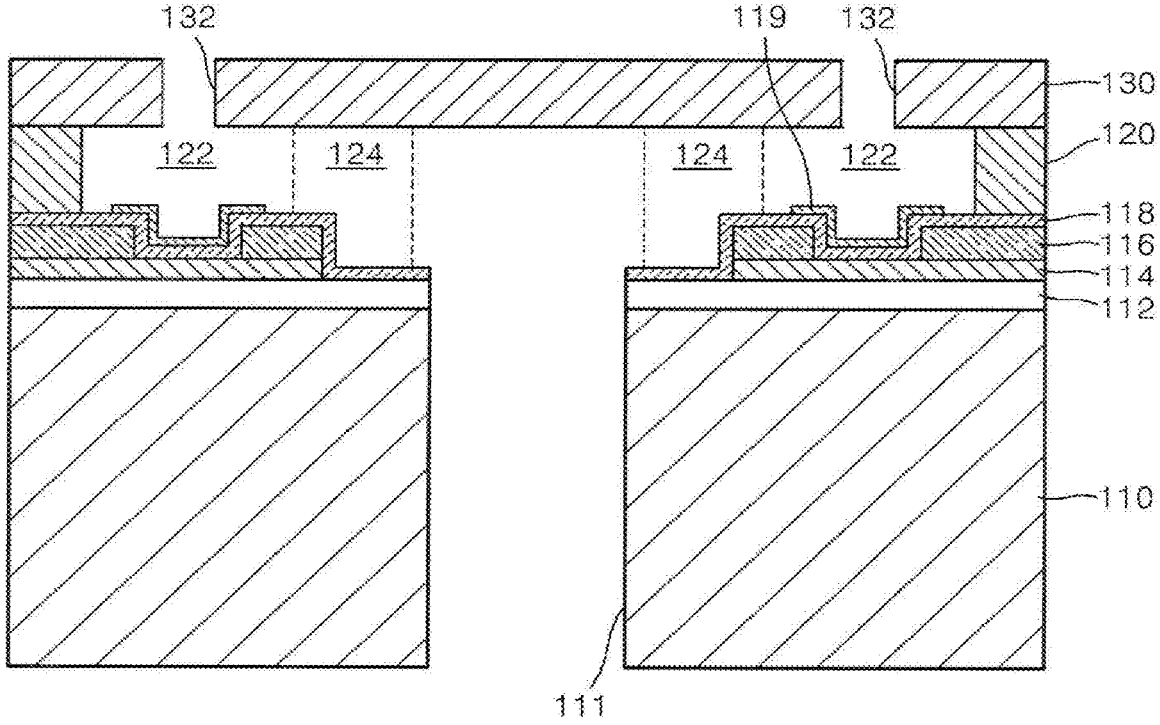

As shown in FIGS. 19 and 20, the ink feed hole 111 may be formed by etching the substrate 110 so as to penetrate the substrate 110 from the bottom surface of the substrate 110 exposed to the etch mask 140, and the etch mask 140 is removed. The etching of the substrate 110 may be performed by dry etching using plasma. Meanwhile, the etching of the substrate 110 may also be performed using wet etching using tetramethyl ammonium hydroxide (TMAH) or KOH as an etchant. Alternatively, the etching of the substrate 110 may be performed using a laser, or other methods. Finally, the sacrificial layer S may be removed using a solvent to prepare an inkjet printhead including ink chambers 122 and restrictors 124 surrounded by the chamber layer 120 as shown in FIG. 21.

The disclosure will now be described in greater detail by reference to the following non-limiting examples.

EXAMPLES

Example 1

Preparation of Negative Photoresist Composition 53.33 parts by weight of SU-8 epoxy resin (manufactured by Resolution Performance Chemicals) as a bisphenol-A novolac epoxy resin, 13.33 parts by weight of NC-3000H epoxy resin (manufactured by Nippon Kayaku Co., Ltd.) as a first epoxy resin, 26.68 parts by weight of cyclopentane (CP) as a solvent, and 6.66 parts by weight of Cyracure 6974 (manufactured by Dow Chemcial Co.) as a cationic photoinitiator are added to a jar to prepare a resist solution. The resist solution may be mixed using an impeller for about 24 hours and filtered using a 5 mm filter to prepare a negative photoresist composition.

Example 2

Preparation of Negative Photoresist Composition

A negative photoresist composition may be prepared in the same manner as in Example 1, except that the resist solution may be prepared by mixing 24.0 parts by weight of SU-8 epoxy resin (manufactured by Resolution Performance Chemicals) as the bisphenol-A novolac epoxy resin, 13.33 parts by weight of NC-3000H epoxy resin (manufactured by Nippon Kayaku Co., Ltd.) as the first epoxy resin, 24.0 parts by weight of EHPE-3150 epoxy resin (manufactured by Daicel Chemical Industries, Ltd.) as the additional epoxy resin, 5.33 parts by weight of trimethylolpropane triglycinyl ether (manufactured by Resolution Performance Products) as the reactive monomer, 26.68 parts by weight of cyclopentane (CP) as the solvent, and 6.66 parts by weight of Cyracure 6974 (manufactured by Dow Chemcial Co.) as the cationic photoinitiator.

Example 3

Preparation of Negative Photoresist Composition

A negative photoresist composition may be prepared in the same manner as in Example 1, except that the resist solution may be prepared by mixing 34.62 parts by weight of SU-8 epoxy resin (manufactured by Resolution Performance Chemicals) as the bisphenol-A novolac epoxy resin, 30.46 parts by weight of NER-7604 epoxy resin (manufactured by Nippon Kayaku Co., Ltd.) as the second epoxy resin, 2.77 parts by weight of polypropylene glycol diglycidyl ether (ED 506, manufactured by Asahi-Denka Co., Ltd.) as the reactive monomer, 25.23 parts by weight of cyclopentane (CP) as the solvent, 5.54 parts by weight of Cyracure 6974 (manufactured by Dow Chemical Co.) as the cationic photoinitiator, and 1.38 parts by weight of 3-glycidoxypropyltrimethoxysilane (manufactured by Dow Corning Corporation) as the adhesive intensifier.

Example 4

Preparation of Negative Photoresist Composition

A negative photoresist composition may be prepared in the same manner as in Example 1, except that the resist solution may be prepared by mixing 66.66 parts by weight of SU-8 epoxy resin (manufactured by Resolution Performance Chemicals) as the bisphenol-A novolac epoxy resin, 26.68 parts by weight of cyclopentane (CP) as the solvent, and 6.66 parts by weight of Cyracure 6974 (manufactured by Dow Chemcial Co.) as the cationic photoinitiator.

Example 5

Preparation of the Inkjet Printhead (Negative Photoresist of Example 1)

An insulating layer 112 having a thickness of about 2 μm and formed of a silicon oxide, a tantalum nitride heater pattern 114 having a thickness of about 500 Å, an electrode pattern having a thickness of about 500 Å and formed of AlSiCu alloy in which the amount of Si and Cu is respectively 1% by weight or less, a silicon nitride passivation layer 118 having a thickness of about 3000 Å, and an anti-cavitation layer 119 having a thickness of about 3000 Å and formed of tantalum are sequentially formed on a 6-inch silicon wafer 110 by using a conventional sputtering process and photolithography process (FIG. 3).

The silicon wafer 110 on which the layers may be formed may be treated at 200° C. for 10 minutes to remove moisture, and treated with hexamethyldisliazane (HMD) as an adhesion promoter material.

The negative photoresist composition prepared in Example 1 may be spin coated on the overall surface of the wafer at 2000 rpm for 40 seconds, and baked at 95° C. for 7 minutes to form a first negative photoresist layer, i.e., the chamber material layer 120', having a thickness of about 10 μm (FIG. 11). The first negative photoresist layer may be exposed to i-line UV light of about 130 mJ/cm$^2$ using a first photomask having predetermined ink chamber and restrictor patterns. The wafer may be baked at 95° C. for 3 minutes, dipped in a PGMEA developer for 1 minutes, and rinsed using isopropanol for 20 seconds. Thus, a chamber layer 120 may be prepared (FIG. 12).

As shown in FIG. 13, an imide-based positive photoresist (Model No.: PW-1270, manufactured by TORAY Industries, Inc.) may be spin coated on the overall surface of the wafer, on which the pattern of the chamber layer 120 may be formed, at 1000 rpm for 40 seconds and baked at about 140° C. for 10 minutes to form a sacrificial layer S. The thickness of the sacrificial layer S may be controlled so that the thickness of the sacrificial layer S formed on the pattern of the chamber layer 120 is about 5 μm.

The top surfaces of the pattern of the chamber layer 120 and the sacrificial layer S may be planarized using a chemical mechanical polishing (CMP) process as shown in FIG. 14. For this, the wafer may be supplied onto a polishing pad (Model No.: JSR FP 8000, manufactured by JSR Corporation) of a polishing plate such that the sacrificial layer S faced the polishing pad. The wafer may be pressed onto the polishing pad, under a pressure of 10-15 kPa with a backing pad, by a press head. While polishing slurries (POLIPLA 103, manufactured by FUJIMI Corporation) may be supplied onto the polishing pad, the press head may be rotated with respect to the polishing pad. The rotation speeds of the press head and the polishing pad may both be about 40 rpm. The backing pad may be made of a material having a Shore D hardness of about 30 to about 70. The sacrificial layer S may be planarized at an etch rate of 5 to 7 μm until the top surface of the pattern of the chamber layer 120 may be removed by a thickness of about 1 μm.

A pattern of the nozzle layer 130 may be formed on the silicon wafer 110, on which the pattern of the chamber layer 120 and the sacrificial layer S are formed, in the same conditions as in the formation of the pattern of the chamber layer 120 using the negative photoresist composition prepared in Example 1 and a photomask (FIGS. 15, 16, and 17).

An etch mask 140 for forming the ink feed hole 111 may be formed on the bottom surface of the silicon wafer 110 using conventional photolithography, as shown in FIG. 18. The bottom surface of the silicon wafer 110 exposed through the etch mask 140 may be etched using a plasma etching process to form the ink feed hole 111, and the etch mask 140 may be removed (see FIGS. 19 and 20). At this time, the etching power of a plasma etching apparatus may be adjusted to 2000 Watts, the etching gas may be a mixture gas of $SF_6$ and $O_2$ (mixture ratio: 10:1 by volume), and the etch rate may be about 3.7 μm/min.

Finally, the wafer may be dipped in a methyl lactate solvent for 2 hours to remove the sacrificial layer S, thereby forming ink chambers 122 and restrictors 124 surrounded by the chamber layer 120 in the space obtained by the removal of the sacrificial layer S, and resulting in the inkjet printhead, as shown in FIG. 21.

Example 6

Preparation of the Inkjet Printhead (Negative Photoresist of Example 2)

An inkjet printhead may be prepared in the same manner as in Example 5, except that the negative photoresist composition prepared according to Example 2 may be used instead of the negative photoresist composition prepared according to Example 1.

Example 7

Preparation of the Inkjet Printhead (Negative Photoresist of Example 3)

An inkjet printhead may be prepared in the same manner as in Example 5, except that the negative photoresist composition prepared according to Example 3 may be used instead of the negative photoresist composition prepared according to Example 1.

Example 8

Preparation of Comparative Inkjet Printhead (Negative Photoresist of Example 4

An inkjet printhead may be prepared in the same manner as in Example 1, except that the negative photoresist composition prepared according to Example 4 may be used instead of the negative photoresist composition prepared according to Example 1.

Example 9

Delamination Test

Ink is ejected using the inkjet printheads prepared according to Examples 5 to 7 and Example 8, over 1,000 times to observe delamination of the chamber layer and the nozzle layer from the silicon wafer. The results are shown in Table 1.

Evaluation

○: Delamination was not observed over 1 billion times

X : Delamination was observed under 1,000 times

TABLE 1

| | Test result |
|---|---|
| Example 5 | ○ |
| Example 6 | ○ |
| Example 7 | ○ |
| Example 8 | X |

Referring to Table 1, the nozzle layer and the chamber layer of the inkjet printheads prepared according to Examples 5 to 7 were not delaminated after ink was ejected over 1 billion times. However, the nozzle layer and the chamber layer of the inkjet printhead prepared according to Example 8 is delaminated after under 1,000 times of the ejection of ink.

The inkjet printheads of Examples 5 to 7 were prepared using the negative photoresist composition including the bisphenol-A novolac epoxy resin represented by Formula 1, and at least one epoxy resin selected from the first epoxy resin represented by Formula 2 and the second epoxy resin represented by Formula 3. Since the first epoxy resin and the second epoxy resin have flexibility, which is distinctive from the bisphenol-A novolac epoxy resin, and an excellent adhesion force to the surface of metal, friability and cracks of a cured product of the bisphenol-A novolac epoxy resin may be reduced by using the first epoxy resin and the second epoxy resin.

While the present disclosure has been particularly shown and described with reference to exemplary embodiments thereof, it will be understood by those of ordinary skill in the art that various changes in form and details may be made therein without departing from the spirit and scope of the present disclosure as defined by the following claims.

What is claimed is:

1. An inkjet printhead, comprising:

a substrate having an ink feed hole;

a chamber layer formed on the substrate, wherein the chamber layer comprises a plurality of ink chambers in which ink supplied from the ink feed hole is filled; and a nozzle layer formed on the chamber layer, wherein the nozzle layer comprises a plurality of nozzles through which ink is ejected, wherein the chamber layer and the nozzle layer are formed of cured products of a first negative photoresist composition and a second negative photoresist composition, wherein the first negative photoresist composition and the second negative photoresist composition comprise a bisphenol-A novolac epoxy resin represented by Formula 1; at least one epoxy resin selected from a first epoxy resin represented by Formula 2; and a second epoxy resin represented by Formula 3; a cationic photoinitiator; and a solvent:

Formula 1

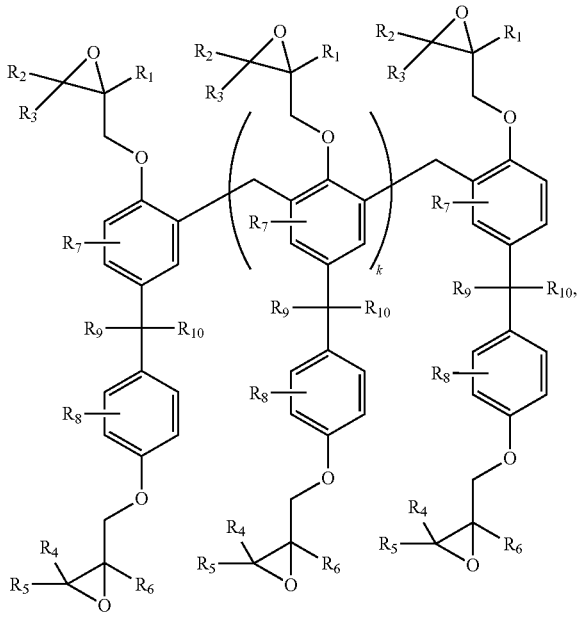

Formula 2

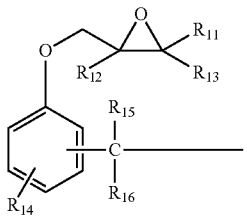

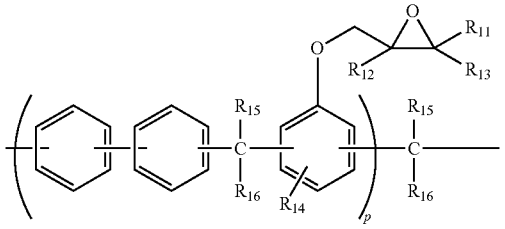

-continued

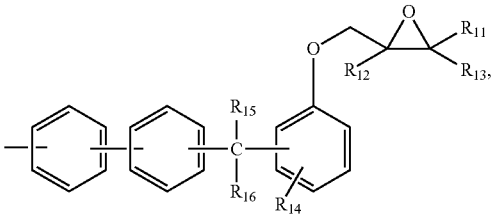

Formula 3

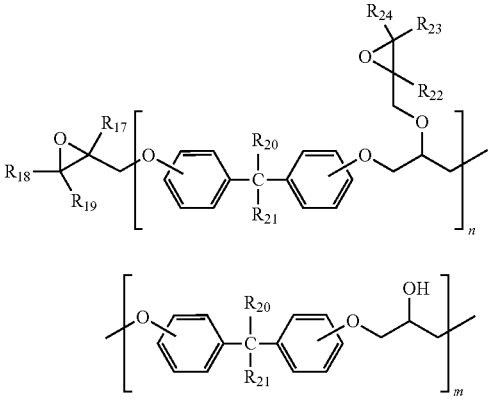

-continued

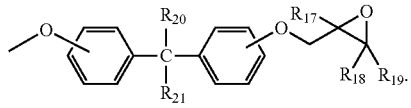

wherein k, p, n and m are each independently an integer of 1 to 30; and wherein $R_1$ through $R_{24}$ are each independently a hydrogen atom, a halogen atom, a hydroxyl group, an amino group, a nitro group, a cyano group, a substituted or unsubstituted $C_1$-$C_{20}$ alkyl group, a substituted or unsubstituted $C_1$-$C_{20}$ carboxyl group, a substituted or unsubstituted $C_1$-$C_{20}$ alkylsiloxane group, a substituted or unsubstituted $C_1$-$C_{20}$ alkoxy group, a substituted or unsubstituted $C_2$-$C_{20}$ alkenyl group, a substituted or unsubstituted $C_2$-$C_{20}$ alkynyl group, a substituted or unsubstituted $C_1$-$C_{20}$ heteroalkyl group, a substituted or unsubstituted $C_6$-$C_{30}$ aryl group, a substituted or unsubstituted $C_7$-$C_{30}$ arylalkyl group, a substituted or unsubstituted $C_5$-$C_{30}$ heteroaryl group, or a substituted or unsubstituted $C_3$-$C_{30}$ heteroarylalkyl group.

2. The inkjet printhead of claim 1, wherein the bisphenol-A novolac epoxy resin, the first epoxy resin, and the second epoxy resin are represented by Formula 4, 5, and 6, respectively:

Formula 4

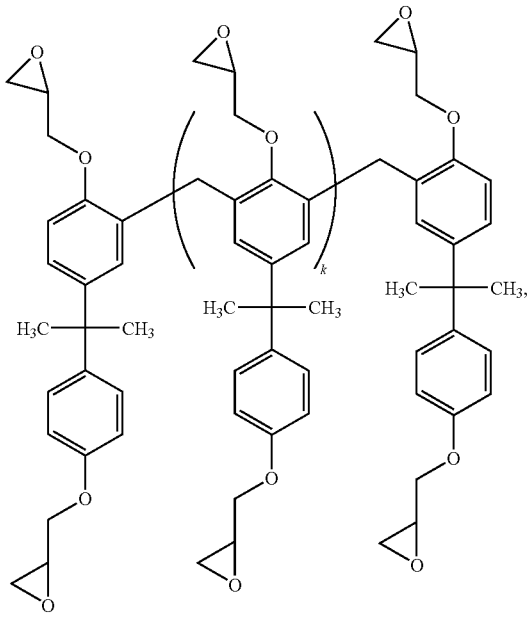

Formula 5

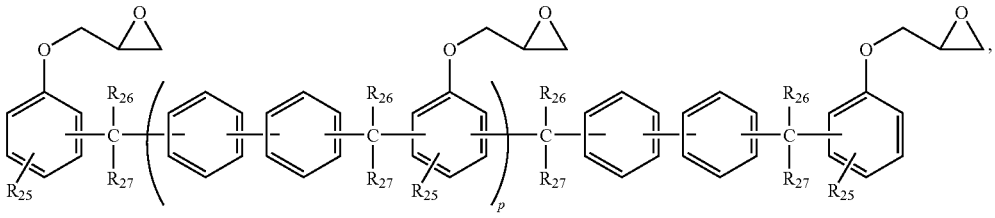

-continued

Formula 6

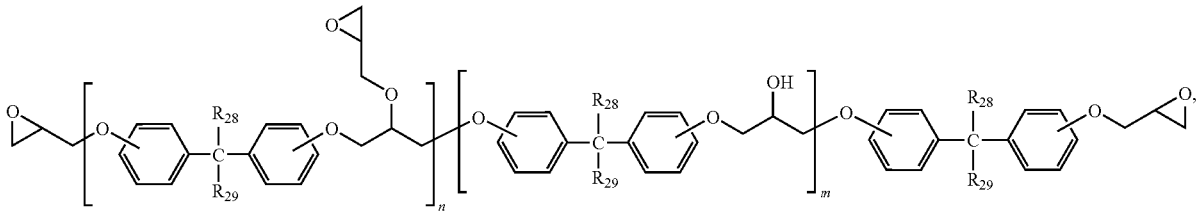

wherein k, p, n and m are each independently an integer of 1 to 30; and wherein $R_{25}$ to $R_{29}$ are each independently a hydrogen atom or a substituted or unsubstituted $C_1$-$C_{20}$ alkyl group.

3. The inkjet printhead of claim 1, wherein the cationic photoinitiator is an aromatic halonium salt or an aromatic sulfonium salt.

4. The inkjet printhead of claim 1, wherein the solvent is α-butyrolactone, γ-butyrolactone, propylene glycol methyl ethyl acetate, tetrahydrofuran, methyl ethyl ketone, methyl isobutyl ketone, cyclopentanone, xylene, or a combination thereof.

5. The inkjet printhead of claim 1, wherein the amount of the at least one epoxy resin selected from the first epoxy resin and the second epoxy resin may be from about 10 to about 1,900 parts by weight based on about 100 parts of the bisphenol-A novolac epoxy resin; the amount of the cationic photoinitiator is from about 0.1 to about 200 parts by weight based on about 100 parts of the bisphenol-A novolac epoxy resin; and the amount of solvent is from about 5 to about 2,000 parts by weight based on about 100 parts of the bisphenol-A novolac epoxy resin.

6. The inkjet printhead of claim 1, further comprising:

an insulating layer formed on the substrate;

a plurality of heaters and electrodes sequentially formed on the insulating layer; and a passivation layer formed so as to cover the plurality of heaters and electrodes.

7. The inkjet printhead of claim 6, further comprising an anti-cavitation layer on the passivation layer.

8. The inkjet printhead of claim 1, further comprising a glue layer interposed between the substrate and the chamber layer.

9. A method of manufacturing an inkjet printhead, comprising:

forming a chamber layer on a substrate;

forming an ink feed hole on the substrate;

forming a nozzle layer comprising a plurality of nozzles on the chamber layer; and forming an ink chamber and a restrictor through the ink feed hole, wherein the chamber layer and the nozzle layer are respectively formed of cured products of a first negative photoresist composition and a second negative photoresist composition, wherein the first negative photoresist composition and the second negative photoresist composition comprise a bisphenol-A novolac epoxy resin represented by Formula 1; at least one epoxy resin selected from a first epoxy resin represented by Formula 2; and a second epoxy resin represented by Formula 3; a cationic photoinitiator; and a solvent:

Formula 1

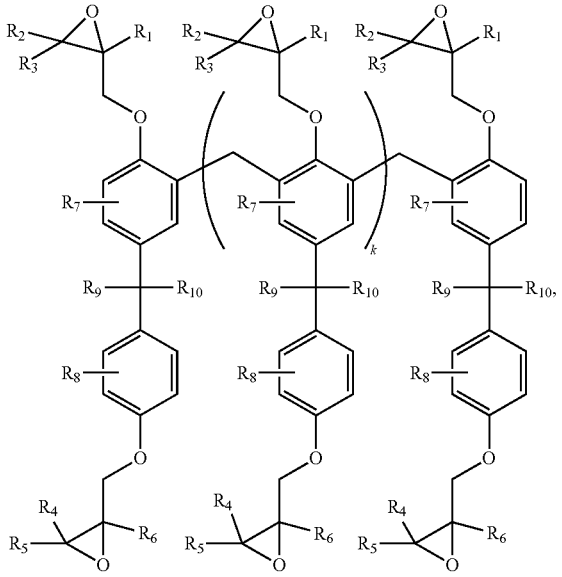

-continued

Formula 2

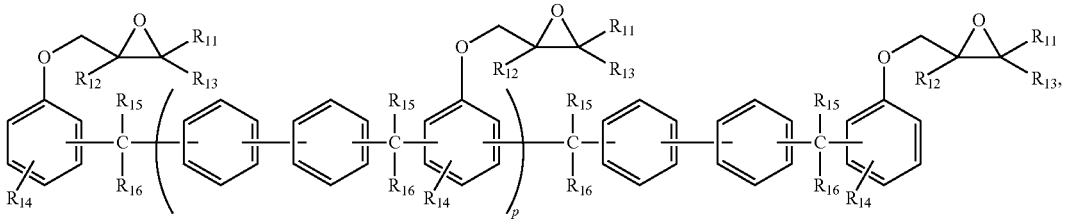

Formula 3

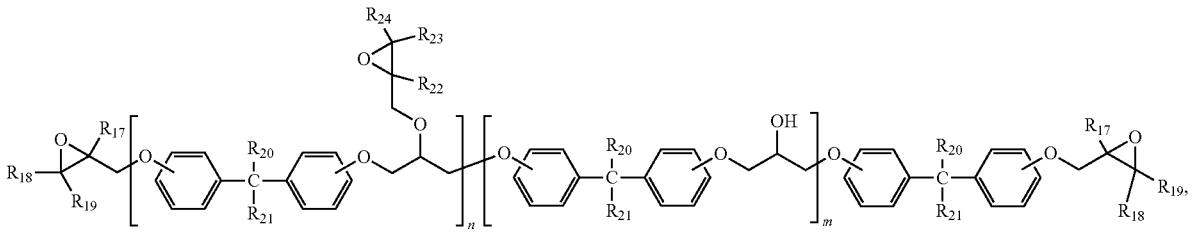

wherein k, p, n and m are each independently an integer of 1 to 30; and wherein $R_1$ through $R_{24}$ are each independently a hydrogen atom, a halogen atom, a hydroxyl group, an amino group, a nitro group, a cyano group, a substituted or unsubstituted $C_1$-$C_{20}$ alkyl group, a substituted or unsubstituted $C_1$-$C_{20}$ carboxyl group, a substituted or unsubstituted $C_1$-$C_{20}$ alkylsiloxane group, a substituted or unsubstituted $C_1$-$C_{20}$ alkoxy group, a substituted or unsubstituted $C_2$-$C_{20}$ alkenyl group, a substituted or unsubstituted $C_2$-$C_{20}$ alkynyl group, a substituted or unsubstituted $C_1$-$C_{20}$ heteroalkyl group, a substituted or unsubstituted $C_6$-$C_{30}$ aryl group, a substituted or unsubstituted $C_7$-$C_{30}$ arylalkyl group, a substituted or unsubstituted $C_5$-$C_{30}$ heteroaryl group, or a substituted or unsubstituted $C_3$-$C_{30}$ heteroarylalkyl group.

10. The method of claim 9, wherein the bisphenol-A novolac epoxy resin, the first epoxy resin, and the second epoxy resin are represented by Formula 4, 5, and 6, respectively:

Formula 4

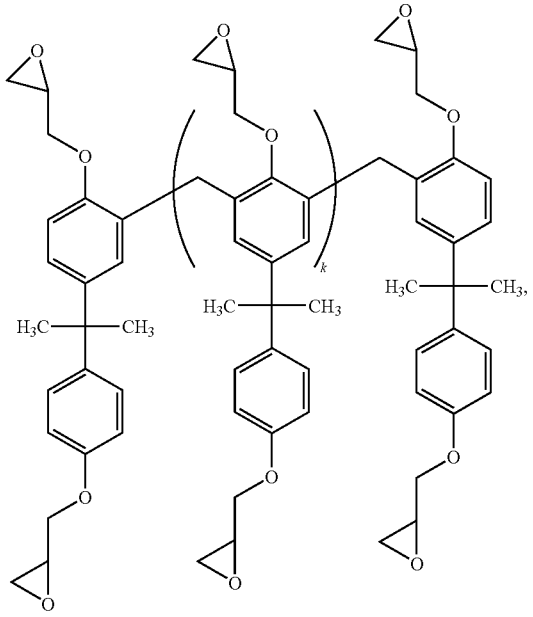

-continued

Formula 5

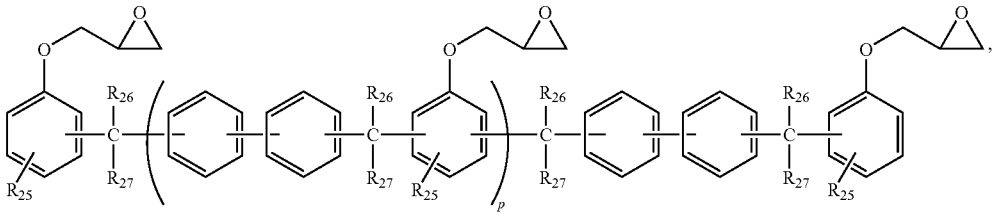

Formula 6

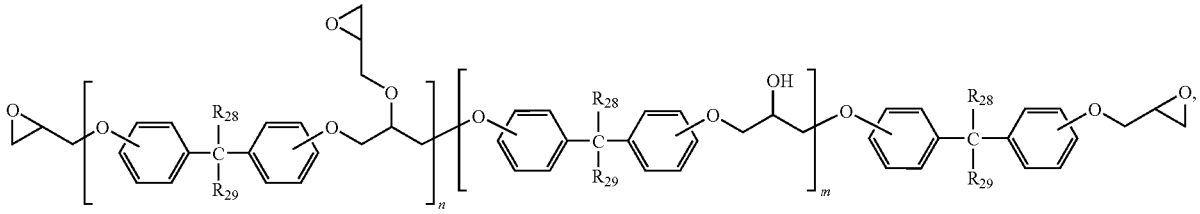

wherein k, p, n and m are each independently an integer of 1 to 30; and wherein $R_{25}$ to $R_{29}$ are each independently a hydrogen atom or a substituted or unsubstituted $C_1$-$C_{20}$ alkyl group.

11. The method of claim 9, wherein the amount of the at least one epoxy resin selected from the first epoxy resin and the second epoxy resin may be from about 10 to about 1,900 parts by weight based on about 100 parts of the bisphenol-A novolac epoxy resin; the amount of the cationic photoinitiator is from about 0.1 to about 200 parts by weight based on about 100 parts of the bisphenol-A novolac epoxy resin; and the amount of solvent is from about 5 to about 2,000 parts by weight based on about 100 parts of the bisphenol-A novolac epoxy resin.

12. The method of claim 9, further comprising:

forming an insulating layer on the substrate;

sequentially forming a plurality of heaters and electrodes on the insulating layer; and forming a passivation layer so as to cover the plurality of heaters and electrodes before forming the chamber layer on the substrate.

13. The method of claim 12, further comprising:

forming an anti-cavitation layer on the passivation layer.

14. A method of manufacturing an inkjet printhead, comprising:

forming a chamber layer on a substrate;

forming a nozzle layer comprising a plurality of nozzles on the chamber layer;

forming an ink feed hole on the bottom surface of the substrate; and forming an ink chamber and a restrictor through the ink feed hole, wherein the chamber layer and the nozzle layer are formed of cured products of a first negative photoresist composition and a second negative photoresist composition, wherein the first negative photoresist composition and the second negative photoresist composition comprise a bisphenol-A novolac epoxy resin represented by Formula 1; at least one epoxy resin selected from a first epoxy resin represented by Formula 2; and a second epoxy resin represented by Formula 3; a cationic photoinitiator; and a solvent:

Formula 1

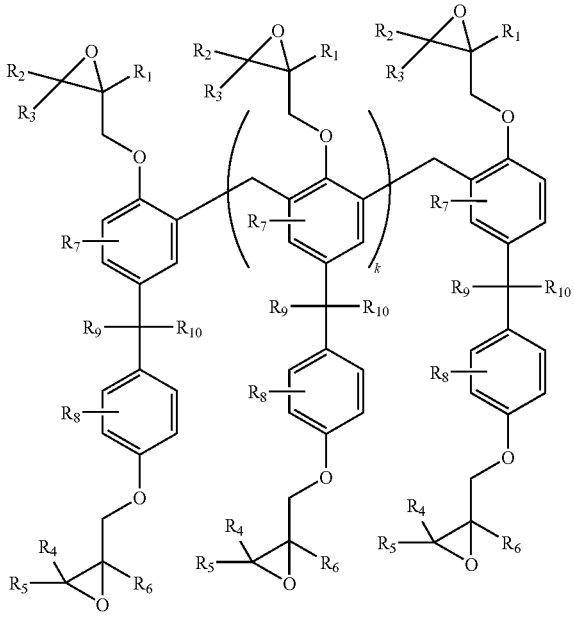

-continued

Formula 2

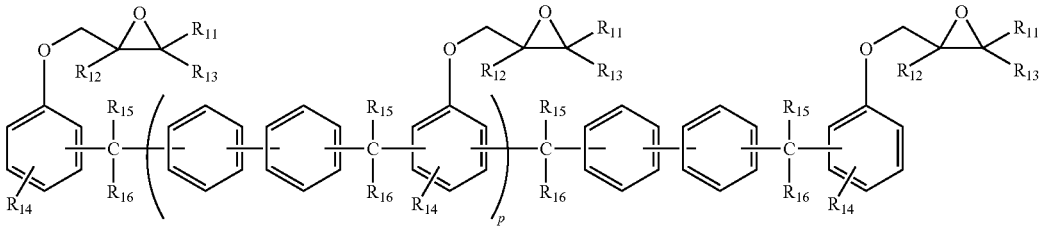

Formula 3

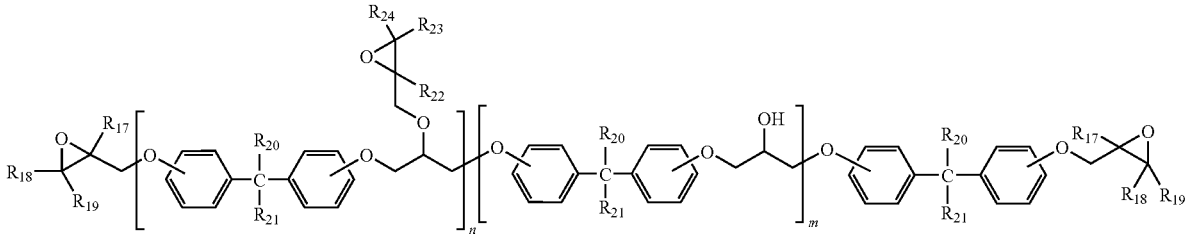

wherein k, p, n and m are each independently an integer of 1 to 30; and wherein $R_1$ through $R_{24}$ are each independently a hydrogen atom, a halogen atom, a hydroxyl group, an amino group, a nitro group, a cyano group, a substituted or unsubstituted $C_1$-$C_{20}$ alkyl group, a substituted or unsubstituted $C_1$-$C_{20}$ carboxyl group, a substituted or unsubstituted $C_1$-$C_{20}$ alkylsiloxane group, a substituted or unsubstituted $C_1$-$C_{20}$ alkoxy group, a substituted or unsubstituted $C_2$-$C_{20}$ alkenyl group, a substituted or unsubstituted $C_2$-$C_{20}$ alkynyl group, a substituted or unsubstituted $C_1$-$C_{20}$ heteroalkyl group, a substituted or unsubstituted $C_6$-$C_{30}$ aryl group, a substituted or unsubstituted $C_7$-$C_{30}$ arylalkyl group, a substituted or unsubstituted $C_5$-$C_{30}$ heteroaryl group, or a substituted or unsubstituted $C_3$-$C_{30}$ heteroarylalkyl group.

15. The method of claim 14, wherein the bisphenol-A novolac epoxy resin, the first epoxy resin, and the second epoxy resin are represented by Formula 4, 5, and 6, respectively:

Formula 4

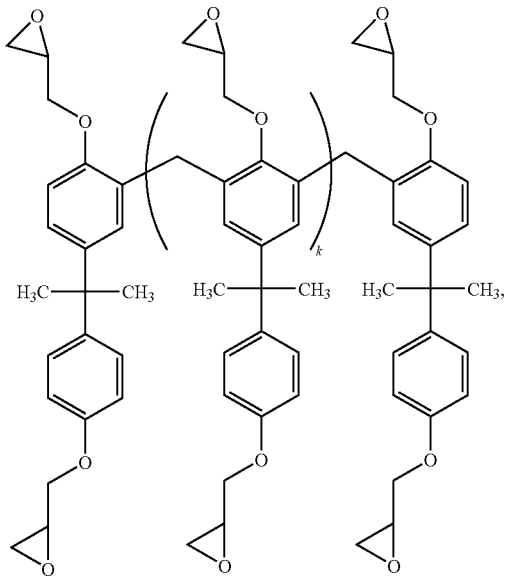

Formula 5

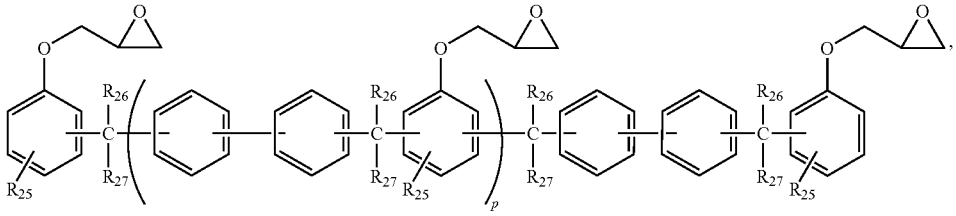

-continued

Formula 6

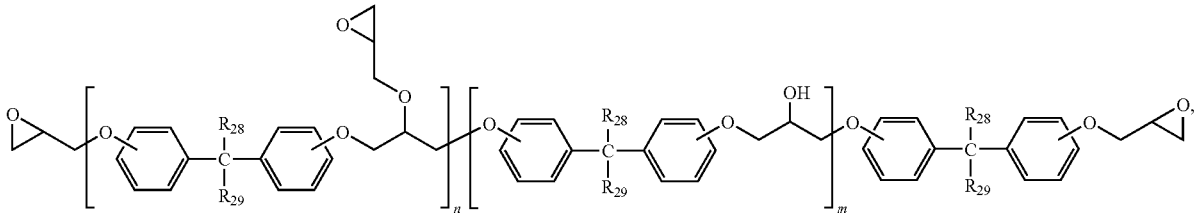

wherein k, p, n and m are each independently an integer of 1 to 30; and wherein $R_{25}$ to $R_{29}$ are each independently a hydrogen atom or a substituted or unsubstituted $C_1$-$C_{20}$ alkyl group.

16. The method of claim 14, wherein the amount of the at least one epoxy resin selected from the first epoxy resin and the second epoxy resin may be from about 10 to about 1,900 parts by weight based on about 100 parts of the bisphenol-A novolac epoxy resin; the amount of the cationic photoinitiator is from about 0.1 to about 200 parts by weight based on about 100 parts of the bisphenol-A novolac epoxy resin; and the amount of solvent is from about 5 to about 2,000 parts by weight based on about 100 parts of the bisphenol-A novolac epoxy resin.

17. The method of claim 14, further comprising:

forming an insulating layer on the substrate;

sequentially forming a plurality of heaters and electrodes on the insulating layer; and forming a passivation layer so as to cover the plurality of heaters and electrodes before forming the chamber layer on the substrate.

18. The method of claim 17, further comprising:

forming an anti-cavitation layer on the passivation layer.

* * * * *